US006613733B1

(12) United States Patent
Barnabas et al.

(10) Patent No.: US 6,613,733 B1
(45) Date of Patent: Sep. 2, 2003

(54) TREATING COMPOSITIONS COMPRISING POLYSACCHARIDES

(75) Inventors: Mary Vijayarani Barnabas, West Chester, OH (US); Johan Smets, Lubeek (BE); Freddy Arthur Barnabas, West Chester, OH (US); Michael Stanford Showell, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/937,261

(22) PCT Filed: Apr. 25, 2000

(86) PCT No.: PCT/US00/11016

§ 371 (c)(1),
(2), (4) Date: Sep. 24, 2001

(87) PCT Pub. No.: WO00/65014

PCT Pub. Date: Nov. 2, 2000

Related U.S. Application Data

(60) Provisional application No. 60/131,287, filed on Apr. 27, 1999.

(51) Int. Cl.[7] ..... C11D 3/22; D06M 15/03

(52) U.S. Cl. ..... 510/470; 510/276; 510/471; 510/473; 8/137

(58) Field of Search ..... 510/276, 470, 510/471, 473; 8/137

(56) References Cited

U.S. PATENT DOCUMENTS 4,116,854 A 9/1978 Temple et al.
5,919,271 A * 7/1999 Baillely et al. ..... 8/137
5,948,744 A * 9/1999 Baillely et al. ..... 510/299

FOREIGN PATENT DOCUMENTS

| | | | |
|---|---|---|---|
| CN | 8 607 435 A | 7/1988 | |
| DK | 9 801 395 A | 11/1998 | |
| WO | WO 88/01316 | 2/1988 | |
| WO | WO 90/02790 | 3/1990 | |
| WO | WO 00/40684 | 7/2000 | |
| WO | WO 00/65014 | * 11/2000 | ..... C11D/3/22 |

OTHER PUBLICATIONS

Hercules Inc., "Guar gum anti–redeposition agent in liquid detergents for washing soiled clothes e.g. of polyester cotton" WPI World Patent Inf. Aug. 6, 1978 Abstract Only 1 Page.

* cited by examiner

*Primary Examiner*—Mark Kopec
*Assistant Examiner*—Brian P. Mruk
(74) *Attorney, Agent, or Firm*—C. Brant Cook; Kim W. Zerby; Steven W. Miller

(57) ABSTRACT

The present invention relates to treating compositions, preferably laundry and/or color care compositions comprising polysaccharides, and methods of using such compositions to provide improved color appearance and/or pill prevention and/or abrasion resistance and/or wrinkle resistance and/or shrinkage resistance benefits, while at the same time providing improved cleaning benefits, over laundry and/or fabric and/or color care compositions without such polysaccharides.

13 Claims, No Drawings

TREATING COMPOSITIONS COMPRISING POLYSACCHARIDES

This application claims the benefit of Provisional application Ser. No. 60/131,287, filed Apr. 27, 1999.

TECHNICAL FIELD

The present invention relates to treating compositions comprising a polysaccharide, and to a method for treating fabrics, natural fibers, such as cellulosic fibers, more particularly cotton, rayon, ramie, jute, flax, linen, polynosic-fibers, Lyocell, poly/cotton, other cotton blends and mixtures thereof, with such compositions for providing the fabrics with improved color appearance and/or pill prevention and/or abrasion resistance and/or wrinkle resistance and/or shrinkage resistance compared to treating compositions without such polysaccharides.

BACKGROUND OF THE INVENTION

Consumer desirability for fabric garments that "look like new", or in other words, fabric garments that retain their "new" appearance, especially with respect to their color appearance has risen.

However, colored garments, especially cotton, rayon and linen garments, have a tendency to wear and show appearance losses. A portion of this color loss may be attributed to abrasion in the laundering process, particularly in automatic washing machines and automatic laundry dryers.

Accordingly, there is a need for treating compositions that provide, refurbish, restore and/or improve the color appearance and/or pill prevention and/or abrasion resistance and/or wrinkle resistance and/or shrinkage resistance of fabrics.

SUMMARY OF THE INVENTION

The present invention is a treating composition comprising polysaccharides and a method for imparting color appearance and/or pill prevention and/or abrasion resistance and/or wrinkle resistance and/or shrinkage resistance properties to fabrics such as cotton, rayon, ramie, jute, flax, linen, polynosic-fibers, Lyocell, poly/cotton, other cotton blends and mixtures thereof.

In accordance with one aspect of the present invention, a treating composition comprising polysaccharides is provided.

In accordance with yet another aspect of the present invention, a method for treating a fabric in need of treatment comprising contacting the fabric with an effective amount of a polysaccharide-containing treating composition such that the treating composition treats the fabric is provided.

A preferred treating composition in accordance with the present invention comprises one or more polysaccharides and one or more cleaning adjunct materials as described hereinafter, preferably selected from the group consisting of builders, bleaching agents, dye transfer inhibiting agents, chelants, dispersants, polysaccharides, softening agents, suds suppressors, carriers, enzymes, enzyme stabilizing systems, polyacids, soil removal agents, anti-redeposition agents, hydrotropes, opacifiers, antioxidants, bactericides, dyes, perfumes, brighteners and mixtures thereof, and optionally, but preferably further comprising a surfactant. Preferably, the treating composition is in the form of powder or granules. However, the treating composition may be in the form of a liquid such as an aqueous or non-aqueous heavy duty liquid detergent composition, a liquid for spray application, or a solid, such as a concentrated stick, for rubbing onto the fabric.

Preferably, the treating composition is applied to the fabric through the wash and/or through the rinse cycles. However, the treating composition can be applied to the fabric prior to the wash and/or after the wash and/or rinse cycles, such as during or prior to ironing, if needed.

All percentages and proportions herein are by weight, and all references cited herein are hereby incorporated by reference, unless otherwise specifically indicated.

DETAILED DESCRIPTION OF THE INVENTION

Definitions

The treating compositions of the present invention comprise an "effective amount" of a polysaccharide. An "effective amount" of a polysaccharide is any amount capable of measurably improving the color appearance and/or pill prevention and/or abrasion resistance and/or wrinkle resistance and/or shrinkage resistance properties of a fabric when it is washed. In general, this amount may vary quite widely.

"Treating composition(s)" herein is meant to encompass generally laundry and/or fabric care compositions and/or fabric conditioners.

Polysaccharide-Containing Treating Composition

In a preferred embodiment, the treating compositions of the present invention comprise an effective amount of one or more polysaccharides and are preferably free of starch and/or starch derivatives and/or resins. Preferably, the treating compositions further comprise one or more cleaning adjunct materials. These treating compositions are useful in the methods of the present invention.

It is desirable that the polysaccharide is present in the treating composition of the present invention in an amount in the range of from about 0.01% to about 50% by weight of the treating composition, more preferably from about 0.5% to about 10% by weight of the treating composition. Furthermore, it is desirable that the polysaccharide is present in the wash, soaking and/or spray-treatment solution in amount in the range of from about 2 ppm to about 25000 ppm, more preferably from about 10 ppm to about 5000 ppm.

The treating composition can include conventional detergent ingredients, such as one or more of the following ingredients selected from the group consisting of surfactants, builders, bleaches, bleach activators, bleach catalysts, enzymes, enzyme stabilizing systems, soil release/removal agents, suds suppressors, polyacids, anti-redeposition agents, hydrotropes, opacifiers, antioxidants, bactericides, dyes, perfumes, carriers and brighteners. Examples of such ingredients are generally described in U.S. Pat. No. 5,576,282.

Forms of Compositions

The treating compositions of the present invention can be in solid (powder, granules, bars, tablets), dimple tablets, liquid, paste, gel, spray, stick or foam forms.

The liquid forms can also be in a "concentrated" form which are diluted to form compositions with the usage concentrations, as given hereinbelow, for use in the "usage conditions". Concentrated compositions comprise a higher level of polysaccharide, typically from about 1% to about 99%, preferably from about 2% to about 65%, more preferably from about 3% to about 25%, by weight of the concentrated treating composition. Concentrated compositions are used in order to provide a less expensive product. When a concentrated product is used, i.e., when the polysaccharide is from about 1% to about 99%, by weight of the concentrated composition, it is preferable to dilute the composition, preferably with water, before treating a fabric in need of treatment. Preferably, the water content of the "concentrated" form is less than 40%, more preferably less than 30%, most preferably less than 20% by weight of the detergent composition.

The present invention also relates to polysaccharide-containing treating compositions incorporated into a spray dispenser to create an article of manufacture that can facilitate treatment of fabric articles and/or surfaces with said compositions containing the polysaccharide and other optional ingredients at a level that is effective, yet is not discernible when dried on the surfaces. The spray dispenser comprises manually activated and non-manual powered (operated) spray means and a container containing the treating composition. The articles of manufacture preferably are in association with instructions for use to ensure that the consumer applies sufficient polysaccharide to provide the desired benefit.

Typical compositions to be dispensed from a sprayer contain a level of polysaccharide of from about 0.01% to about 5%, preferably from about 0.05% to about 2%, more preferably from about 0.1% to about 1%, by weight of the usage composition.

For wash-added and rinse-added methods, the article of manufacture can simply comprise a liquid or granular solid polysaccharide-containing treating composition and a suitable container.

Wash-added compositions, including liquid and granular detergent compositions and wash additive compositions typically contain a level of polysaccharide of from about 0.01% to about 30%, preferably from about 0.5% to about 20%, more preferably from about 1% to about 12%, by weight of the wash added compositions.

Typical rinse-added compositions, including liquid fabric conditioner and other rinse additive compositions, contain a level of polysaccharide of from about 0.01% to about 40%, preferably from about 0.3% to about 25%, more preferably from about 0.5% to about 25%, most preferably from about 1% to about 10%, by weight of the rinse added compositions.

Preferably the articles of manufacture are in association with instructions for how to use the composition to treat fabrics correctly, to obtain the desirable fabric care results, for example, improved color appearance and/or pill prevention and/or abrasion resistance and/or wrinkle resistance and/or shrinkage resistance, while at the same time providing improved cleaning benefits, including, e.g., the manner and/or amount of composition to be used, and the preferred ways of stretching and/or smoothing, if any, the fabrics. It is important that the instructions be as simple and clear as possible. Accordingly, the use of pictures and/or icons to assist in explaining the instructions is desirable.

Liquid or solid, preferably powder, polysaccharide-containing treating composition for treating fabric in the rinse step in accordance with the present invention comprise an effective amount of the polysaccharide of the present invention, and optionally, fabric softener actives, perfume, electrolytes, chlorine scavenging agents, dye transfer inhibiting agents, dye fixative agents, phase stabilizers, chemical stabilizers including antioxidants, silicones, antimicrobial actives and/or preservatives, chelating agents, aminocarboxylate chelating agents, colorants, enzymes, brighteners, soil release agents, anti-encrustation agents, builders and/or mixtures thereof. Again, the composition is preferably packaged in association with instructions for use to ensure that the consumer knows what benefits can be achieved.

Yet another liquid or solid, preferably powder or granular, treating composition in accordance with the present invention to be used in the wash cycle comprises an effective amount of one or more polysaccharides, and optionally, surfactants, builders, perfume, chlorine scavenging agents, dye transfer inhibiting agents, dye fixative agents, dispersants, detergent enzymes, heavy metal chelating agents, suds suppressors, fabric softener actives, chemical stabilizers including antioxidants, silicones, antimicrobial actives and/or preservatives, soil suspending agents, soil release agents, optical brighteners, colorants, and the like, or mixtures thereof. Again, the composition is preferably packaged in association with instructions for use to ensure that the consumer knows what benefits can be achieved.

A preferred treating composition for treating fabric comprises an effective amount of one or more polysaccharides, and optionally, perfume, fabric lubricants, adjunct fabric shape retention polymers, lithium salts, hydrophilic plasticizers, odor control agents, antimicrobial actives and/or preservatives, surfactants, enzymes, or mixtures thereof. Other optional ingredients can also be added, e.g., antioxidants, chelating agents, e.g., aminocarboxylate chelating agents, heavy metal chelating agents, antistatic agents, insect and moth repelling agents, dye transfer inhibiting agents, dye fixative agents, colorants, suds suppressors, and the like, and mixtures thereof. The composition is typically applied to fabric via a, e.g., dipping, soaking and/or spraying process followed by a drying step, including the process comprising a step of treating or spraying the fabric with the treating composition either outside or inside an automatic clothes dryer followed by, or concurrently with, the drying step in said clothes dryer. However, the composition may be applied by spraying the fabric with the treating composition prior to and/or during ironing, if needed. Also, the composition may be applied by spraying the fabric during dry cleaning. The application can be done industrially by large scale processes on textiles and/or finished garments and clothings, or in consumer's home by the use of commercial product.

The treating compositions herein can be made by any suitable process known in the art. Examples of such processes are described in U.S. Pat. No. 5,576,282.

The treating compositions herein will preferably be formulated such that, during use in aqueous cleaning operations, the wash water will have a pH of between about 6.5 and about 11, preferably between about 7.5 and 11. Techniques for controlling pH at recommended usage levels include the use of buffers, alkalis, acids, etc., and are well known to those skilled in the art.

Non-aqueous based heavy duty laundry detergent compositions containing the polysaccharide preferably comprise from about 55% to about 98.9% by weight of the detergent composition of a structured, surfactant-containing liquid phase formed by combining:

(a) from about 1% to about 80% by weight of the liquid phase of one or more non-aqueous organic diluents; and (b) from about 20% to about 99% by weight of the liquid phase of a surfactant system comprising surfactants selected from the group consisting of anionic, nonionic, cationic surfactants and mixtures thereof.

Aqueous based heavy duty laundry detergent compositions containing the polysaccharide preferably contain a surfactant system comprising surfactants selected from the group consisting of nonionic detersive surfactants, anionic detersive surfactants, zwitterionic detersive surfactants, amine oxide detersive surfactants and mixtures thereof. The surfactant system typically comprises from about 0.01% to about 50%, preferably from about 0.2% to about 30% by weight of the detergent composition.

Another appropriate form in which the treating compositions of the present invention may be incorporated are tablets. Such polysaccharide-containing treating composition tablets comprise an effective amount of one or more polysaccharides, and optionally, surfactants, builders, perfume, chlorine scavenging agents, dye transfer inhibiting agents, dye fixative agents, dispersants, detergent enzymes, heavy metal chelating agents, suds suppressors, fabric softener actives, chemical stabilizers including antioxidants, silicones, antimicrobial actives and/or preservatives, soil suspending agents, soil release agents, optical brighteners, colorants, and the like, or mixtures thereof. Again, the composition is preferably packaged in association with instructions for use to ensure that the consumer knows what benefits can be achieved. The tablets can be used in pre-wash and/or pretreatment procedures as well as through the wash and/or rinse cycles.

Alternatively, the treating compositions of the present invention can be incorporated into a spray dispenser, or concentrated stick form that can create an article of manufacture that can facilitate the cleaning and/or fabric care or conditioning of fabric. If the spray treatment is a "pre-treat", which is followed by a wash cycle, then the spray treatment treating compositions preferably comprise from about 0.01% to about 50% of polysaccharide by weight the of total treating composition, more preferably from about 0.1% to about 3% of polysaccharide by weight of the total treating composition. If the spray treatment compositions are desired to do the cleaning, as in the case of wash, then the spray treatment compositions preferably comprise from about 2 ppm to about 10000 ppm of the polysaccharide by weight of the total treating composition, more preferably from about 200 ppm to about 5000 ppm of the polysaccharide by weight of the total treating composition. In the latter case, a brief rinse, not a full wash cycle, is desirable after treatment. Such spray treatment compositions are typically packaged in a spray dispenser.

The spray-treatment compositions herein are typically packaged in spray dispensers. The spray dispensers can be any of the manually activated means for producing a spray of liquid droplets as is known in the art, e.g. trigger-type, pump-type, non-aerosol self-pressurized, and aerosol-type spray means. It is preferred that at least about 70%, more preferably, at least about 80%, most preferably at least about 90% of the droplets have a particle size of smaller than about 200 microns.

The spray dispenser can be an aerosol dispenser. Said aerosol dispenser comprises a container which can be constructed of any of the conventional materials employed in fabricating aerosol containers. The dispenser must be capable of withstanding internal pressure in the range of from about 20 to about 110 p.s.i.g., more preferably from about 20 to about 70 p.s.i.g. The one important requirement concerning the dispenser is that it be provided with a valve member which will permit the treating compositions of the present invention contained in the dispenser to be dispensed in the form of a spray of very fine, or finely divided, particles or droplets. A more complete description of commercially available suitable aerosol spray dispensers appears in U.S. Pat. No. 3,436,772, Stebbins, issued Apr. 8, 1969; and U.S. Pat. No. 3,600,325, Kaufman et al., issued Aug. 17, 1971.

Preferably the spray dispenser is a self-pressurized non-aerosol container having a convoluted liner and an elastomeric sleeve. A more complete description of suitable self-pressurized spray dispensers can be found in U.S. Pat. No. 5,111,971, Winer, issued May 12, 1992; and U.S. Pat. No. 5,232,126, Winer, issued Aug. 3, 1993. Another type of suitable aerosol spray dispenser is one wherein a barrier separates the wrinkle reducing composition from the propellant (preferably compressed air or nitrogen), as is disclosed in U.S. Pat. No. 4,260,110, issued Apr. 7, 1981, incorporated herein by reference. Such a dispenser is available from EP Spray Systems, East Hanover, N.J.

More preferably, the spray dispenser is a non-aerosol, manually activated, pump-spray dispenser. A more complete disclosure of commercially available suitable dispensing devices appears in: U.S. Pat. No. 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981.

Most preferably, the spray dispenser is a manually activated trigger-spray dispenser. A more complete disclosure of commercially available suitable dispensing devices appears in U.S. Pat. No. 4,082,223, Nozawa, issued Apr. 4, 1978; U.S. Pat. No. 4,161,288, McKinney, issued Jul. 7, 1985; U.S. Pat. No. 4,434,917, Saito et al., issued Mar. 6, 1984; and U.S. Pat. No. 4,819,835, Tasaki, issued Apr. 11, 1989; U.S. Pat. No. 5,303,867, Peterson, issued Apr. 19, 1994.

A broad array of trigger sprayers or finger pump sprayers are suitable for use with the compositions of this invention. These are readily available from suppliers such as Calmar, Inc., City of Industry, Calif.; CSI (Continental Sprayers, Inc.), St. Peters, Mo.; Berry Plastics Corp., Evansville, Ind.—a distributor of Guala® sprayers; or Seaquest Dispensing, Cary, Ill.

The preferred trigger sprayers are the blue inserted Guala® sprayer, available from Berry Plastics Corp., the Calmar TS800-1A® sprayers, available from Calmar Inc., or the CSI T7500® available from Continental Sprayers Inc., because of the fine uniform spray characteristics, spray volume and pattern size. Any suitable bottle or container can be used with the trigger sprayer, the preferred bottle is a 17 fl-oz. bottle (about 500 ml) of good ergonomics similar in shape to the Cinch® bottle. It can be made of any materials such as high density polyethylene, polypropylene, polyvinyl chloride, polystyrene, polyethylene terephthalate, glass or any other material that forms bottles. Preferably, it is made of high density polyethylene or polyethylene terephthalate.

For smaller four fl-oz size (about 118 ml), a finger pump can be used with canister or cylindrical bottle. The preferred pump for this application is the cylindrical Euromist II® from Seaquest Dispensing.

It has been found that polysaccharides impart to the fabric improved color appearance and/or pill prevention and/or abrasion resistance and/or wrinkle resistance and/or shrinkage resistance. These benefits provided by the polysaccharide improve the appearance of the fabric.

Methods of Treating

Fabrics, preferably finished garments, can be treated with the polysaccharide-containing treating compositions by any method known in the art that accomplishes contacting the fabric with the polysaccharide-containing treating composition.

A preferred embodiment of the present invention is a method for treating a fabric in need of treatment, wherein the method comprises contacting the fabric with an effective amount of polysaccharide-containing treating composition such that the treating composition treats the fabric.

Preferably, the polysaccharide treating composition is in contact with the fabric for an "effective amount of time", which herein means the-amount of time required for the polysaccharide-containing treating composition to adequately treat a fabric such that the fabric acquires improved color appearance and/or pill prevention and/or abrasion resistance and/or wrinkle resistance and/or shrinkage resistance properties. Such time can vary quite widely, however, a preferred range of time is from about 5 minutes to about 60 minutes, more preferably from about 10 minutes to about 30 minutes.

Suitable methods include, but are not limited to, washing the fabric in a solution containing the polysaccharide-containing treating composition. The washing can be manual or automatic, such as in a washing machine. The washing machine used in the method described herein can be any conventional washing machine known in the art. In addition, it can be a specially designed washing machine such as the washing machine described in U.S. Pat. No. 5,520,025 to Joo et al.

Other suitable methods include, but are not limited to, soaking the fabric in a solution containing the polysaccharide-containing treating composition; spraying the fabric with a solution containing the polysaccharide-containing treating composition; rubbing the fabric with a solid containing the polysaccharide-containing treating composition; dipping the fabric in a solution containing the polysaccharide-containing treating composition; rolling the polysaccharide-containing treating composition onto the fabric, spreading the polysaccharide-containing treating composition onto the fabric and brushing the polysaccharide-containing treating composition onto the fabric.

In addition to the methods for treating fabrics in need of treatment and other surfaces, described herein, the invention herein also encompasses a laundering pretreatment process for fabrics which have been soiled or stained comprising directly contacting said stains and/or soils with a highly concentrated form of the polysaccharide-containing treating composition, in any form, preferably a concentrated liquid preferably in a spray dispenser or roll-on device), stick or bar, set forth above prior to washing such fabrics using conventional aqueous washing solutions. Preferably, the cleaning composition remains in contact with the soil/stain for a period of from about 30 seconds to 24 hours prior to washing the pretreated soiled/stained substrate in conventional manner. More preferably, pretreatment times will range from about 1 to 180 minutes.

Such methods can be used in industrial applications, such as in the textile industry, or in residential (domestic) applications, preferably, the methods are used in the residential (domestic) applications.

Further, these methods can be used independently of one another, or can be combined, concurrently or sequentially.

The use of the treating compositions of the present invention in accordance with these methods maintains the color appearance and/or pill prevention and/or abrasion resistance and/or wrinkle resistance and/or shrinkage resistance of a fabric in need of treatment through multiple wash cycles.

Product/Instructions

The present invention also encompasses the inclusion of instructions on the use of the polysaccharide-containing treating compositions with the packages containing the treating compositions herein or with other forms of advertising associated with the sale or use of the treating compositions. The instructions may be included in any manner typically used by consumer product manufacturing or supply companies. Examples include providing instructions on a label attached to the container holding the composition; on a sheet either attached to the container or accompanying it when purchased; or in advertisements, demonstrations, and/or other written or oral instructions which may be connected to the purchase of the treating compositions.

The instructions, for instance, may include information relating to the temperature of the wash water; washing time; recommended settings on the washing machine; recommended amount of the treating composition to use; pre-soaking procedures; and spray-treatment procedures.

A product comprising a polysaccharide-containing treating composition, the product further including instructions for using the treating composition to treat a fabric in need of treatment, the instructions including the step of: contacting said fabric with an effective amount of said treating composition for an effective amount of time such that said composition treats said fabric.

The product may be a laundry detergent composition, a fabric care composition or fabric conditioner. Furthermore, the product may be contained in a spray dispenser.

Polysaccharides

"Polysaccharides" herein is meant natural polysaccharides, and does not include polysaccharide derivatives or modified polysaccharides. Suitable polysaccharides for use in the treating compositions of the present invention include, but are not limited to, gums, arabinans, galactans, seeds and mixtures thereof.

Suitable polysaccharides that are useful in the present invention include polysaccharides with a degree of polymerization (DP) over 40, preferably from about 50 to about 100,000, more preferably from about 500 to about 50,000, constituting saccharides preferably include, but are not limited to, one or more of the following saccharides: isomaltose, isomaltotriose, isomaltotetraose, isomaltooligosaccharide, fructooligosaccharide, levooligosaccharides, galactooligosaccharide, xylooligosaccharide, gentiooligosaccharides, disaccharides, glucose, fructose, galactose, xylose, mannose, sorbose, arabinose, rhamnose, fucose, maltose, sucrose, lactose, maltulose, ribose, lyxose, allose, altrose, gulose, idose, talose, trehalose, nigerose, kojibiose, lactulose, oligosaccharides, maltooligosaccharides, trisaccharides, tetrasaccharides, pentasaccharides, hexasaccharides, oligosaccharides from partial hydrolysates of natural polysaccharide sources and mixtures thereof.

The polysaccharides can be extracted from plants, produced by organisms, such as bacteria, fungi, prokaryotes, eukaryotes, extracted from animals and/or humans. For example, xanthan gum can be produced by *Xanthomonas campestris*, gellan by *Sphingomonas paucimobilis*, xyloglucan can be extracted from tamarind seed.

The polysaccharides can be linear, or branched in a variety of ways, such as 1–2, 1–3, 104, 1–6, 2–3 and mixtures thereof.

It is desirable that the polysaccharides of the present invention have a molecular weight in the range of from about 10,000 to about 10,000,000, more preferably from about 50,000 to about 1,000,000, most preferably from about 50,000 to about 500,000.

Preferably, the polysaccharide is selected from the group consisting of: tamarind gum (preferably consisting of xyloglucan polymers), guar gum, locust bean gum (preferably consisting of galactomannan polymers), and other industrial gums and polymers, which include, but are not limited to, Tara, Fenugreek, Aloe, Chia, Flaxseed, Psyllium seed, quince seed, xanthan, gellan, welan, rhamsan, dextran, curdlan, pullulan, scleroglucan, schizophyllan, chitin, hydroxyalkyl cellulose, arabinan (preferably from sugar beets), de-branched arabinan (preferably from sugar beets), arabinoxylan (preferably from rye and wheat flour), galactan (preferably from lupin and potatoes), pectic galactan (preferably from potatoes), galactomannan (preferably from carob, and including both low and high viscosities), glucomannan, lichenan (preferably from icelandic moss), mannan (preferably from ivory nuts), pachyman, rhamnogalacturonan, acacia gum, agar, alginates, carrageenan, chitosan, clavan, hyaluronic acid, heparin, inulin, cellodextrins, and mixtures thereof. These polysaccharides can also be treated (preferably enzymatically) so that the best fractions of the polysaccharides are isolated.

More preferred polysaccharides have a β-linked backbone.

Xyloglucan polymer is a highly preferred polysaccharide for use in the laundry and/or fabric care compositions of the present invention. Xyloglucan polymer is preferably obtained from tamarind seed polysaccharides. The preferred range of molecular weights for the xyloglucan polymer is from about 10,000 to about 1,000,000, more preferably from about 50,000 to about 200,000.

Polysaccharides, when present, are normally incorporated in the treating composition of the present invention at levels from about 0.1% to about 25%, preferably from about 0.2% to about 10% by weight of the treating composition.

Polysaccharides have a high affinity for binding with cellulose. Without wishing to be bound by theory, it is believed that the binding efficacy of the polysaccharides to cellulose depends on the type of linkage, extent of branching and molecular weight. The extent of binding also depends on the nature of the cellulose (i.e., the ratio of crystalline to amorphous regions in cotton, rayon, linen, etc.).

The natural polysaccharides can be modified with amines (primary, secondary, tertiary), amides, esters, ethers, alcohols, carboxylic acids, tosylates, sulfonates, sulfates, nitrates, phosphates and mixtures thereof. Such a modification can take place in position 2, 3 and/or 6 of the glucose unit. Such modified or derivatized polysaccharides can be included in the compositions of the present invention in addition to the natural polysaccharides.

Nonlimiting examples of such modified polysaccharides include: carboxyl and hydroxymethyl substitutions (e.g., glucuronic acid instead of glucose); amino polysaccharides (amine substitution, e.g., glucosamine instead of glucose); $C_1$–$C_6$ alkylated polysaccharides; acetylated polysaccharide ethers; polysaccharides having amino acid residues attached (small fragments of glycoprotein); polysaccharides containing silicone moieties. Suitable examples of such modified polysaccharides are commercially available from Carbomer and include, but are not limited to, amino alginates, such as hexanediamine alginate, amine functionalized cellulose-like O-methyl-(N-1,12-dodecanediamine) cellulose, biotin heparin, carboxymethylated dextran, guar polycarboxylic acid, carboxymethylated locust bean gum, caroxymethylated xanthan, chitosan phosphate, chitosan phosphate sulfate, diethylaminoethyl dextran, dodecylamide alginate, sialic acid, glucuronic acid, galacturonic acid, mannuronic acid, guluronic acid, N-acetylglucosamine, N-acetylgalactosamine, and mixtures thereof.

The polysaccharide polymers can be linear, like in hydroxyalkylcellulose, the polymer can have an alternating repeat like in carrageenan, the polymer can have an interrupted repeat like in pectin, the polymer can be a block copolymer like in alginate, the polymer can be branched like in dextran, the polymer can have a complex repeat like in xanthan. Descriptions of the polymer definitions are give in "An introduction to Polysaccharide Biotechnology", by M>Tombs and S. E. Harding, T.J. Press 1998.

Oligosaccharides

The compositions of the present invention may include oligosaccharides. Suitable oligosaccharides that are useful in the present invention include oligosaccharides with a degree of polymerization (DP) of less than 20, preferably from about 1 to about 15, more preferably from about 2 to about 10, constituting monosaccharides preferably include, but are not limited to, one or more of the following monosaccharides: glucose, fructose, galactose, xylose, mannose, arabinose, rhamnose, ribose, lyxose, allose, altrose, gulose, idose, talose, and/or their derivatives. Preferred oligosaccharides have a molecular weight in the range of from about 300 to about 8000. Branched oligosaccharides are preferred over linear oligosaccharides.

Nonlimiting examples of suitable oligosaccharides can be obtained commercially from any of the suppliers—Carbomer (fructo-oligosaccharides, levo-oligosaccharides, inulin, dextra 5000, cellosaccharides, etc.,), Grain Processing Corporation (maltodextrin), Pharmacica Biotech (Dextran series), Palatinit (isomalt) and Showa Sangyo (Isomalto-500).

Oligosaccharides, when present, are normally incorporated in the cleaning composition at levels from about 1% to about 25%, preferably from about 2% to about 10% by weight of the laundry and/or fabric care composition.

Cleaning Adjunct Materials

The treating compositions of the present invention comprise an effective amount of the polysaccharide, and preferably one or more of the above-described preferred ingredients, and optionally one or more of the following conventional cleaning adjunct materials either to improve the performance of the polysaccharide, e.g., in the areas of wrinkle control, anti-wear, soil release, tensile strength and the like, or to provide additional benefits, such as odor control, antimicrobial, and the like. The useful optional cleaning adjunct materials are those that are compatible with the polysaccharide, in that they do not interfere and/or substantially or significantly diminish the benefits provided by the polysaccharide. The precise nature of these optional cleaning adjunct materials, and levels of incorporation thereof will depend on the physical form of the treating compositions, and the nature of the cleaning operation for which it is to be used.

Examples of such cleaning adjunct materials include, but are not limited to, the following.

Surfactant System—Detersive surfactants can be, and preferably are included in the treating compositions of the present invention. When present, surfactants comprise at least 0.01%, preferably at least about 0.1%, more preferably at least about 0.5%, most preferably at least about 1% to about 60%, more preferably to about 35%, most preferably to about 30% by weight of the treating composition depending upon the particular surfactants used and the desired effects.

The detersive surfactant can be nonionic, anionic, ampholytic, zwitterionic, cationic, semi-polar nonionic, and mixtures thereof, nonlimiting examples of which are disclosed in U.S. Pat. Nos. 5,707,950 and 5,576,282. Preferred treating compositions comprise anionic detersive surfactants or mixtures of anionic surfactants with other surfactants, especially nonionic surfactants.

Anionic surfactants are highly preferred for use with the treating compositions of the present invention.

Nonlimiting examples of surfactants useful herein include the conventional $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/ propoxy), $C_{12}$–$C_{18}$ betaines and sulfobetaines ("sultaines"), $C_{10}$–$C_{18}$ amine oxides, and the like. Other conventional useful surfactants are listed in standard texts.

The surfactant is preferably formulated to be compatible with enzyme and bleaching components, if any, present in the composition. In liquid or gel compositions the surfactant is most preferably formulated such that it promotes, or at least does not degrade, the stability of any enzyme in these compositions.

Nonionic Surfactants—Polyethylene, polypropylene, and polybutylene oxide condensates of alkyl phenols are suitable for use as the nonionic surfactant of the surfactant systems of the present invention, with the polyethylene oxide condensates being preferred. Commercially available nonionic surfactants of this type include Igepal™ CO-630, marketed by the GAF Corporation; and Triton™ X45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant systems of the present invention. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-3 (the condensation product of $C_{12}$–$C_{13}$ linear alcohol with 3.0 moles of ethylene oxide), Neodol™ 45-7 (the condensation product of $C_{14}$–$C_{15}$ linear alcohol with 7 moles of ethylene oxide), Neodol™ 45-5 (the condensation product of $C_{14}$-$C_{15}$ linear alcohol with 5 moles of ethylene oxide) marketed by Shell Chemical Company, Kyro™ EOB (the condensation product of $C_{13}$–$C_{15}$ alcohol with 9 moles ethylene oxide), marketed by The Procter & Gamble Company, and Genapol LA O30 or O50 (the condensation product of $C_{12}$–$C_{14}$ alcohol with 3 or 5 moles of ethylene oxide) marketed by Hoechst. Preferred range of HLB in these products is from 8–11 and most preferred from 8–10.

Also useful as the nonionic surfactant of the surfactant systems of the present invention are the alkylpolysaccharides disclosed in U.S. Pat. No. 4,565,647.

Preferred alkylpolyglycosides have the formula: $R^2O(C_nH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7.

The condensation products of ethylene oxide with a hydrophobic base formed by the condensation of propylene oxide with propylene glycol are also suitable for use as the additional nonionic surfactant systems of the present invention. Examples of compounds of this type include certain of the commercially-available Plurafac™ LF404 and Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. Examples of this type of nonionic surfactant include certain of the commercially available Tetronic™ compounds, marketed by BASF.

Preferred for use as the nonionic surfactant of the surfactant systems of the present invention are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Highly preferred nonionic surfactants are polyhydroxy fatty acid amide surfactants of the formula: $R^2$—C(O)—N($R^1$)—Z wherein $R^1$ is H, or $R^1$ is $C_1$-4 hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

Anionic Surfactants—Suitable anionic surfactants to be used are linear alkyl benzene sulfonate, alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

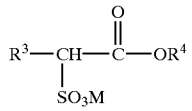

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation. Typically, alkyl chains of $C_{12}$–$C_{16}$ are preferred for lower wash temperatures (e.g. below about 50° C.) and $C_{16-18}$ alkyl chains are preferred for higher wash temperatures (e.g. above about 50° C.).

Other anionic surfactants useful for detersive purposes include salts of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$—M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil.

Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)M), $C_{12}$–$C_{18}$ alkyl polyethoxylate (2.25) sulfate ($C_{12}$–$C_{18}$E(2.25)M), $C_{12}$–$C_{18}$ alkyl polyethoxylate (3.0) sulfate ($C_{12}$–$C_{18}$E(3.0)M), and $C_{12}$–$C_{18}$ alkyl polyethoxylate (4.0) sulfate ($C_{12}$–$Cl_8$E(4.0)M), wherein M is conveniently selected from sodium and potassium.

When included therein, the treating compositions of the present invention typically comprise from about 1%, preferably from about 3% to about 40%, preferably about 20% by weight of such anionic surfactants.

Cationic Surfactants—Cationic detersive surfactants suitable for use in the treating compositions of the present invention are those having one long-chain hydrocarbyl group. Examples of such cationic surfactants include the ammonium surfactants such as alkyltrimethylammonium halogenides, and those surfactants having the formula: $[R^2(OR^3)_y][R^4(OR^3)_y]_2R^5N+X$— wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Highly preferred cationic surfactants are the water-soluble quaternary ammonium compounds useful in the present composition having the formula (i): $R_1R_2R_3R_4N^+X^-$ wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R_4$ should be benzyl. The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulfate, acetate and phosphate ions.

Examples of suitable quaternary ammonium compounds of formulae (i) for use herein are include, but are not limited to: coconut trimethyl ammonium chloride or bromide; coconut methyl dihydroxyethyl ammonium chloride or bromide; decyl triethyl ammonium chloride; decyl dimethyl hydroxyethyl ammonium chloride or bromide; $C_{12-15}$ dimethyl hydroxyethyl ammonium chloride or bromide; coconut dimethyl hydroxyethyl ammonium chloride or bromide; myristyl trimethyl ammonium methyl sulphate; lauryl dimethyl benzyl ammonium chloride or bromide; lauryl dimethyl $(ethenoxy)_4$ ammonium chloride or bromide; choline esters (compounds of formula (i) wherein $R_1$ is $$CH_2—CH_2—O—\underset{\underset{O}{\|}}{C}—C_{12-14}$$ alkyl and $R_2R_3R_4$ are methyl);

and di-alkyl imidazolines [(i)].

Other cationic surfactants useful herein are also described in U.S. Pat. No. 4,228,044, Cambre, issued Oct. 14, 1980 and in European Patent Application EP 000,224.

When included therein, the treating compositions of the present invention typically comprise from about 0.2%, preferably from about 1% to about 25%, preferably to about 8% by weight of such cationic surfactants.

Ampholytic Surfactants—Ampholytic surfactants, examples of which are described in U.S. Pat. No. 3,929,678, are also suitable for use in the treating compositions of the present invention.

When included therein, the treating compositions of the present invention typically comprise from about 0.2%, preferably from about 1% to about 15%, preferably to about 10% by weight of such ampholytic surfactants.

Zwitterionic Surfactants—Zwitterionic surfactants, examples of which are described in U.S. Pat. No. 3,929,678, are also suitable for use in the treating compositions of the present invention.

When included therein, the treating compositions of the present invention typically comprise from about 0.2%, preferably from about 1% to about 15%, preferably to about 10% by weight of such zwitterionic surfactants.

Semi-polar Nonionic Surfactants—Semi-polar nonionic surfactants are a special category of nonionic surfactants which include water-soluble amine oxides having the formula:

$$R^3(OR^4)_xN(R^5)_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups (the $R^5$ groups can be attached to each other, e.g., through an oxygen or nitrogen atom, to form a ring structure); water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

The amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the treating compositions of the present invention typically comprise from about 0.2%, preferably from about 1% to about 15%, preferably to about 10% by weight of such semi-polar nonionic surfactants.

Cosurfactants—The treating compositions of the present invention may further comprise a cosurfactant selected from the group of primary or tertiary amines. Suitable primary amines for use herein include amines according to the formula $R_1NH_2$ wherein $R_1$ is a $C_6$–$C_{12}$, preferably $C_6$–$C_{10}$ alkyl chain or $R_4X(CH_2)_n$, X is —O—, —C(O)NH— or —NH—, $R_4$ is a $C_6$–$C_{12}$ alkyl chain n is between 1 to 5, preferably 3. $R_1$ alkyl chains may be straight or branched and may be interrupted with up to 12, preferably less than 5 ethylene oxide moieties.

Preferred amines according to the formula herein above are n-alkyl amines. Suitable amines for use herein may be selected from 1-hexylamine, 1-octylamine, 1-decylamine and laurylamine. Other preferred primary amines include C8–C10 oxypropylamine, octyloxypropylamine, 2-ethylhexyl-oxypropylamine, lauryl amido propylamine and amido propylamine. The most preferred amines for use in the compositions herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

LFNIs—Low foaming nonionic surfactants (LFNI) which are described in U.S. Pat. Nos. 5,705,464 and 5,710,115 can be included in the treating compositions of the present invention. LFNI may be present in amounts from 0.01% to about 10% by weight, preferably from about 0.1% to about 10%, and most preferably from about 0.25% to about 4%. LFNIs are most typically used in automatic dishwashing detergent compositions (ADDs) on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene (PO/EO/PO) reverse block polymers as described in U.S. Pat. Nos. 5,705,464 and 5,710,115.

LFNIs which may also be used include those POLY-TERGENT® SLF-18 nonionic surfactants from Olin Corp., and any biodegradable LFNI having the melting point properties discussed hereinabove.

These and other nonionic surfactants are well known in the art, being described in more detail in Kirk Othmer's Encyclopedia of Chemical Technology, 3rd Ed., Vol. 22, pp. 360–379, "Surfactants and Detersive Systems", incorporated by reference herein.

Bleaching System—The treating compositions of the present invention may comprise a bleaching system. Bleaching systems typically comprise a "bleaching agent" (source of hydrogen peroxide) and an "initiator" or "catalyst". When present, bleaching agents will typically be at levels of from about 1%, preferably from about 5% to about 30%, preferably to about 20% by weight of the composition. If present, the amount of bleach activator will typically be from about 0.1%, preferably from about 0.5% to about 60%, preferably to about 40% by weight, of the treating composition comprising the bleaching agent-plus-bleach activator.

Bleaching Agents—Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

Compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

If peroxygen bleaching agents are used as all or part of the particulate material, they will generally comprise from about 0.1% to 30% by weight of the composition. More preferably, peroxygen bleaching agent will comprise from about 1% to 20% by weight of the composition. Most preferably, peroxygen bleaching agent will be present to the extent of from about 5% to 20% by weight of the composition.

(a) Bleach Activators—Preferably, the peroxygen bleach component in the composition is formulated with an activator (peracid precursor). The activator is present at levels of from about 0.01%, preferably from about 0.5%, more preferably from about 1%, most preferably from about 3% to about 20%, preferably to about 15%, more preferably to about 10%, most preferably to about 8%, by weight of the composition. Frequently, activators are employed such that the molar ratio of bleaching agent to activator ranges from about 1:1 to 10:1, more preferably from about 1.5:1 to 5:1. In addition, it has been found that bleach activators, when agglomerated with certain acids such as citric acid, are more chemically stable.

Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-nonaoyl)amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Ser. Nos. 08/709,072, 08/064,564, all of which are incorporated herein by reference.

The mole ratio of peroxygen bleaching compound (as AvO) to bleach activator in the present invention generally ranges from at least 1:1, preferably from about 20:1, more preferably from about 10:1 to about 1:1, preferably to about 3:1.

Quaternary substituted bleach activators may also be included. The present cleaning compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. Nos. 5,698,504, 5,695,679, and 5,686,014 each of which are cited herein above. Preferred examples of such bleach activators include: (6-octanamidocaproyl) oxybenzenesulfonate, (6-nonanamidocaproyl)oxybenzenesulfonate, (6-decanamidocaproyl)oxybenzenesulfonate and mixtures thereof.

Other useful activators, disclosed in U.S. Pat. Nos. 5,698,504, 5,695,679, 5,686,014 each of which is cited herein above and U.S. Pat. No. 4,966,723 Hodge et al., issued Oct. 30, 1990, include benzoxazin-type activators, such as a $C_6H_4$ ring to which is fused in the 1,2-positions a moiety —C(O)OC($R^2$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators, as described in U.S. Pat. Nos. 5,698,504, 5,695,679 and 5,686,014, each of which is cited herein above, are very useful herein, especially the acyl caprolactams (see for example WO 94-28102 A) and acyl valerolactams (see U.S. Pat. No. 5,503,639 Willey et al., issued Apr. 2, 1996 incorporated herein by reference).

Cyclic imido bleach activators are represented by the formula:

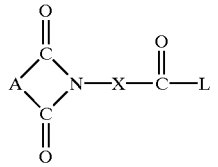

wherein X is selected from substituted or unsubstituted, branched or linear $C_1$–$C_{20}$ alkyl, substituted or unsubstituted, branched or linear $C_2$–$C_{20}$ alkylene. Preferably, X is branched or linear $C_1$–$C_{12}$ alkyl, branched or linear $C_2$–$C_{12}$ alkylene, more preferably branched or linear $C_1$–$C_8$ alkyl, branched or linear $C_2$–$C_8$ alkylene, most preferably linear $C_1$–$C_6$ alkyl. A is selected from:

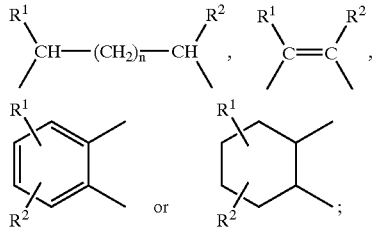

and preferably is:

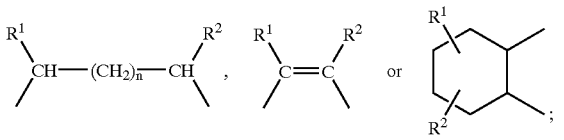

wherein n is selected from the numbers 0, 1, 2, 3 or 4. Preferably, n is 0,1,2 or 3 and more preferably, 0,1, or 2. $R^1$ and $R^2$ are independently selected from the group consisting of hydrogen, chloride, bromide, iodide, substituted or unsubstituted branched or linear $C_1$–$C_{20}$ alkyl, substituted or unsubstituted branched or linear $C_2$–$C_{20}$ alkenyl, substituted or unsubstituted aryl, and substituted or unsubstituted alkylaryl. Preferably $R^1$ and $R^2$ are independently hydrogen, chloride, substituted or unsubstituted branched or linear $C_1$–$C_{18}$ alkyl, substituted or unsubstituted branched or linear $C_2$–$C_{18}$ alkenyl, substituted or unsubstituted aryl, and substituted or unsubstituted alkylaryl. More preferably, $R^1$ and $R^2$ are independently hydrogen, unsubstituted branched or linear $C_1$–$C_{16}$ alkyl, unsubstituted branched or linear $C_2$–$C_{16}$ alkenyl, substituted or unsubstituted phenyl, substituted or unsubstituted napthyl, substituted or unsubstituted alkylphenyl substituted or unsubstituted alkylnapthyl. It is further preferred that one of $R^1$ and $R^2$ is hydrogen or unsubstituted branched or linear $C_1$–$C_6$ alkyl and the other is either an unsubstituted branched or linear $C_1$–$C_{16}$ alkyl or an unsubstituted branched or linear $C_2$–$C_{16}$ alkenyl.

L is a modified or unmodified lactam leaving group. The lactams which are suitable as leaving groups in the present application have the generic structure:

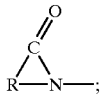

where R represents an optionally substituted alkenyl chain with at least two carbon atoms in the alkenyl chain. This alkenyl chain forms a cyclic structure with the —N— and —C(O)—. The term modified means that the alkenyl can be substituted at least once or that one or more of the alkenyl carbon atoms can be substituted by a suitable heterocycle or any combination of both. Suitable heterocyclic chain substitutes are O, N, and S, with O being preferred. Suitable substituents include, but are not limited to, $C_1$–$C_6$ alkyl, $C_1$–$C_6$ alkenyl, $C_1$–$C_6$ alkoxy, chloride, bromide, iodide. The preferred substituents are $C_1$–$C_6$ alkyl, $C_1$–$C_6$ alkoxy and chloride. The most preferred modified lactam leaving groups are: alpha-chlorocaprolactam, alpha-chlorovalerolactam, alpha,alpha-dichlorolactam, alpha, alpha-dichlorovalerolactam, alpha-methoxycaprolactam, alpha-methoxy-valerolactam,

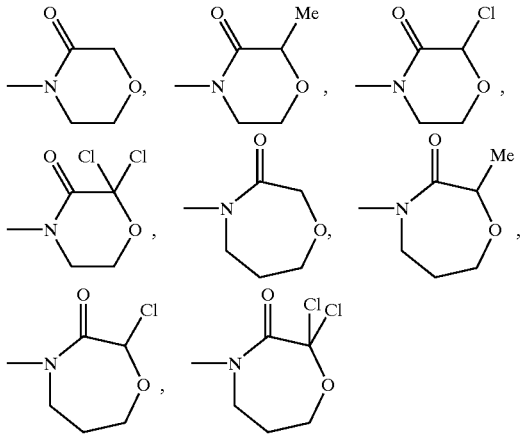

and mixtures thereof.

When the lactams are unmodified, it means that they are contain no substituents other that hydrogen and have no heterocyclic substitution of the alkenyl chain of R. R is preferably an alkenyl chain of two to seven carbon atoms. It is preferred that the lactam leaving group will be unmodified. It is more preferred that the unsubstituted lactam leaving group will be either caprolactam or valerolactam. That is:

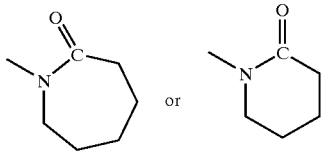

(b) Organic Peroxides, especially Diacyl Peroxides—These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

(c) Metal-containing Bleach Catalysts—The present invention compositions and methods may utilize metal-containing bleach catalysts that are effective for use in bleaching compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243 Bragg, issued Feb. 2, 1982.

Manganese Metal Complexes—If desired, the compositions herein can be catalyzed by means of a manganese compound. Such compounds and levels of use are well known in the art and include, for example, the manganese-based catalysts disclosed in U.S. Pat. Nos. 5,576,282; 5,246,621; 5,244,594; 5,194,416; and 5,114,606; and European Pat. App. Pub. Nos. 549,271 A1, 549,272 A1, 544,440 A2, and 544,490 A1; Preferred examples of these catalysts include $Mn^{IV}_2(u\text{-}O)_3(1,4,7\text{-trimethyl-}1,4,7\text{-triazacyclononane})_2(PF_6)_2$, $Mn^{III}_2(u\text{-}O)_1(u\text{-}OAc)_2(1,4,7\text{-trimethyl-}1,4,7\text{-triazacyclononane})_2(ClO_4)_2$, $Mn^{IV}_4(u\text{-}O)_6(1,4,7\text{-triazacyclononane})_4(ClO_4)_4$, $Mn^{III}Mn^{IV}_4(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. Nos. 4,430,243 and 5,114,611. The use of manganese with various complex ligands to enhance bleaching is also reported in the following: U.S. Pat. Nos. 4,728,455; 5,284,944; 5,246,612; 5,256,779; 5,280,117; 5,274,147; 5,153,161; and 5,227,084.

Cobalt Metal Complexes—Cobalt bleach catalysts useful herein are known, and are described, for example, in U.S. Pat. Nos. 5,597,936; 5,595,967; and 5,703,030; and M. L. Tobe, "Base Hydrolysis of Transition-Metal Complexes", *Adv. Inorg. Bioinorg. Mech.,* (1983), 2, pages 1–94. The most preferred cobalt catalyst useful herein are cobalt pentaamine acetate salts having the formula $[Co(NH_3)_5OAc]T_y$, wherein "OAc" represents an acetate moiety and "Ty" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[(Co(NH_3)_5OAc](SO_4)$; $[Co\text{-}(NH_3)_5OAc](BF_4)_2$; and $[Co(NH_3)_5OAc](NO_3)_2$ (herein "PAC").

These cobalt catalysts are readily prepared by known procedures, such as taught for example in U.S. Pat. Nos. 5,597,936; 5,595,967; and 5,703,030; in the Tobe article and the references cited therein; and in U.S. Pat. No. 4,810,410; *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry,* 56, 22–25 (1952).

Transition Metal Complexes of Macropolycyclic Rigid Ligands—Compositions herein may also suitably include as bleach catalyst a transition metal complex of a macropolycyclic rigid ligand. The phrase "macropolycyclic rigid ligand" is sometimes abbreviated as "MRL" in discussion below. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

Suitable transition metals e.g., Mn are illustrated hereinafter. "Macropolycyclic" means a MRL is both a macrocycle and is polycyclic. "Polycyclic" means at least bicyclic. The term "rigid" as used herein includes "having a superstructure" and "cross-bridged". "Rigid" has been defined as the constrained converse of flexibility: see D. H. Busch., *Chemical Reviews.*, (1993), 93, 847–860, incorporated by reference. More particularly, "rigid" as used herein means that the MRL must be determinably more rigid than a macrocycle ("parent macrocycle") which is otherwise identical (having the same ring size and type and number of atoms in the main ring) but lacking a superstructure (especially linking moieties or, preferably cross-bridging moieties) found in the MRL's. In determining the comparative rigidity of macrocycles with and without superstructures, the practitioner will use the free form (not the metal-bound form) of the macrocycles. Rigidity is well-known to be useful in comparing macrocycles; suitable tools for determining, measuring or comparing rigidity include computational methods (see, for example, Zimmer, *Chemical Reviews*, (1995), 95(38), 2629–2648 or Hancock et al., *Inorganica Chimica Acta*, (1989), 164, 73–84.

Preferred MRL's herein are a special type of ultra-rigid ligand which is cross-bridged. A "cross-bridge" is nonlimitingly illustrated in 1.11 hereinbelow. In 1.11, the cross-bridge is a—$CH_2CH_2$— moiety. It bridges $N^1$ and $N^8$ in the illustrative structure. By comparison, a "same-side" bridge, for example if one were to be introduced across $N^1$ and $N^{12}$ in 1.11, would not be sufficient to constitute a "cross-bridge" and accordingly would not be preferred.

Suitable metals in the rigid ligand complexes include Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV). Preferred transition-metals in the instant transition-metal bleach catalyst include manganese, iron and chromium.

More generally, the MRL's (and the corresponding transition-metal catalysts) herein suitably comprise:

(a) at least one macrocycle main ring comprising four or more heteroatoms; and (b) a covalently connected non-metal superstructure capable of increasing the rigidity of the macrocycle, preferably selected from (i) a bridging superstructure, such as a linking moiety;

(ii) a cross-bridging superstructure, such as a cross-bridging linking moiety; and (iii) combinations thereof.

The term "superstructure" is used herein as defined in the literature by Busch et al., see, for example, articles by Busch in "Chemical Reviews".

Preferred superstructures herein not only enhance the rigidity of the parent macrocycle, but also favor folding of the macrocycle so that it co-ordinates to a metal in a cleft. Suitable superstructures can be remarkably simple, for example a linking moiety such as any of those illustrated in FIG. 1 and FIG. 2 below, can be used.

FIG. 1

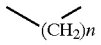

wherein n is an integer, for example from 2 to 8, preferably less than 6, typically 2 to 4, or

FIG. 2

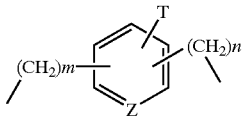

wherein m and n are integers from about 1 to 8, more preferably from 1 to 3; Z is N or CH; and T is a compatible substituent, for example H, alkyl, trialkylammonium, halogen, nitro, sulfonate, or the like. The aromatic ring in 1.10 can be replaced by a saturated ring, in which the atom in Z connecting into the ring can contain N, O, S or C.

Suitable MRL's are further nonlimitingly illustrated by the following compound:

FIG. 3

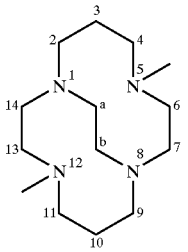

This is a MRL in accordance with the invention which is a highly preferred, cross-bridged, methyl-substituted (all nitrogen atoms tertiary) derivative of cyclam. Formally, this ligand is named 5,12-dimethyl-1,5,8,12-tetraazabicyclo [6.6.2]hexadecane using the extended von Baeyer system. See "A Guide to IUPAC Nomenclature of Organic Compounds: Recommendations 1993", R. Panico, W. H. Powell and J-C Richer (Eds.), Blackwell Scientific Publications, Boston, 1993; see especially section R-2.4.2.1.

Transition-metal bleach catalysts of Macrocyclic Rigid Ligands which are suitable for use in the invention compositions can in general include known compounds where they conform with the definition herein, as well as, more preferably, any of a large number of novel compounds expressly designed for the present laundry or cleaning uses, and non-limitingly illustrated by any of the following:

Dichloro-5,12-dimethyl-1,5,8,12-tetraazabicyclo[6.6.2] hexadecane Manganese(II)

Diaquo-5,12-dimethyl-1,5,8,12-tetraazabicyclo[6.6.2] hexadecane Manganese(II) Hexafluorophosphate Aquo-hydroxy-5,12-dimethyl-1,5,8,12-tetraazabicyclo [6.6.2]hexadecane Manganese(III) Hexafluorophosphate Diaquo-5,12-dimethyl-1,5,8,12-tetraazabicyclo[6.6.2] hexadecane Manganese(II) Tetrafluoroborate Dichloro-5,12-dimethyl-1,5,8,12-tetraazabicyclo[6.6.2] hexadecane Manganese(III) Hexafluorophosphate Dichloro-5,12-di-n-butyl-1,5,8,12-tetraazabicyclo[6.6.2] hexadecane Manganese(II)

Dichloro-5,12-dibenzyl-1,5,8,12-tetraazabicyclo[6.6.2] hexadecane Manganese(II)

Dichloro-5-n-butyl-12-methyl-1,5,8,12-tetraaza-bicyclo [6.6.2]hexadecane Manganese(II)

Dichloro-5-n-octyl-12-methyl-1,5,8,12-tetraaza-bicyclo [6.6.2]hexadecane Manganese(II)

Dichloro-5-n-butyl-12-methyl-1,5,8,12-tetraaza-bicyclo [6.6.2]hexadecane Manganese(II).

As a practical matter, and not by way of limitation, the compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the bleaching compositions.

(d) Other Bleach Catalysts—The compositions herein may comprise one or more other bleach catalysts. Preferred bleach catalysts are zwitterionic bleach catalysts, which are described in U.S. Pat. No. 5,576,282 (especially 3-(3,4-dihydroisoquinolinium) propane sulfonate. Other bleach catalysts include cationic bleach catalysts are described in U.S. Pat. Nos. 5,360,569, 5,442,066, 5,478,357, 5,370,826, 5,482,515, 5,550,256, and WO 95/13351, WO 95/13352, and WO 95/13353.

As a practical matter, and not by way of limitation, the compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the cleaning compositions.

(e) Preformed peracids—Also suitable as bleaching agents are preformed peracids, such as phthalimido-peroxy-caproic acid ("PAP"). See for example U.S. Pat. Nos. 5,487,818, 5,310,934, 5,246,620, 5,279,757 and 5,132,431.

Enzymes—The treating compositions herein may also optionally contain one or more types of detergent enzymes. Such enzymes can include other proteases, amylases and lipases. They may be incorporated into the non-aqueous liquid detergent compositions herein in the form of suspensions, "marumes" or "prills". Another suitable type of enzyme comprises those in the form of slurries of enzymes in nonionic surfactants, e.g., the enzymes marketed by Novo Nordisk under the tradename "SL" or the microencapsulated enzymes marketed by Novo Nordisk under the tradename "LDP." Suitable enzymes and levels of use are described in U.S. Pat. Nos. 5,576,282, 5,705,464 and 5,710,115.

Enzymes added to the compositions herein in the form of conventional enzyme prills are especially preferred for use herein. Such prills will generally range in size from about 100 to 1,000 microns, more preferably from about 200 to 800 microns and will be suspended throughout the non-aqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

However, enzymes added to the compositions herein may be in the form of granulates, preferably T-granulates.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Examples of suitable enzymes include, but are not limited to, hemicellulases, peroxidases, proteases, xylanases, lipases, phospholipases, esterases, cutinases, pectinases, keratanases, reductases, oxidases, phenoloxidases, lipoxygenases, ligninases, pullulanases, tannases, pentosanases, malanases, glucanases, arabinosidases, hyaluronidase, chondroitinase, laccase, mannanases, xyloglucanases and known amylases, or mixtures thereof.

Examples of such suitable enzymes are disclosed in U.S. Pat. Nos. 5,705,464, 5,710,115, 5,576,282, 5,728,671 and 5,707,950.

Peroxidase enzymes are used in combination with oxygen sources, e.g. percarbonate, perborate, persulfate, hydrogen peroxide, etc and with a phenolic substrate as bleach enhancing molecule. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Suitable peroxidases and peroxidase-containing detergent compositions are disclosed, for example, in U.S. Pat. Nos. 5,705,464, 5,710,115, 5,576,282, 5,728,671 and 5,707,950, PCT International Application WO 89/099813, WO89/09813 and in European Patent application EP No. 91202882.6, filed on Nov. 6, 1991 and EP No. 96870013.8, filed Feb. 20, 1996. Also suitable is the laccase enzyme.

Enhancers are generally comprised at a level of from 0.1% to 5% by weight of total composition. Preferred enhancers are substituted phenthiazine and phenoxasine 10-Phenothiazinepropionicacid (PPT), 10-ethylphenothiazine4carboxylic acid (EPC), 10-phenoxazinepropionic acid (POP) and 10-methylphenoxazine (described in WO 94/12621) and substitued syringates (C3–C5 substitued alkyl syringates) and phenols. Sodium percarbonate or perborate are preferred sources of hydrogen peroxide. Said peroxidases are normally incorporated in the cleaning composition at levels from 0.0001% to 2% of pure enzyme by weight of the cleaning composition.

Enzymatic systems may be used as bleaching agents. The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other preferred enzymes that can be included in the cleaning compositions of the present invention include lipases. Suitable lipase enzymes for detergent usage include those produced by microorganisms of the Pseudomonas group, such as Pseudomonas stutzeri ATCC 19.154, as disclosed in British Patent No. 1,372,034. Suitable lipases include those which show a positive immunological cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. Especially suitable lipases are lipases such as M1 Lipase$^R$ and Lipomax$^R$ (Gist-Brocades) and Lipolase$^R$ and Lipolase Ultra$^R$(Novo) which have found to be very effective when used in combination with the compositions of the present invention. Also suitable are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to cleaning compositions have been described in e.g. WO-A-88/09367 (Genencor); WO 90/09446 (Plant Genetic System) and WO 94/14963 and WO 94/14964 (Unilever).

Lipases and/or cutinases, when present, are normally incorporated in the cleaning composition at levels from 0.0001% to 2% of pure enzyme by weight of the cleaning composition.

In addition to the above referenced lipases, phospholipases may be incorporated into the cleaning compositions of the present invention. Nonlimiting examples of suitable phospholipases included: EC 3.1.1.32 Phospholipase A1; EC 3.1.1.4 Phospholipase A2; EC 3.1.1.5 Lysopholipase; EC 3.1.4.3 Phospholipase C; EC 3.1.4.4. Phospolipase D. Commercially available phospholipases include LECITASE® from Novo Nordisk A/S of Denmark and Phospholipase A2 from Sigma. When phospolipases are included in the compositions of the present invention, it is preferred that amylases are also included. Without desiring to be bound by theory, it is believed that the combined action of the phospholipase and amylase provide substantive stain removal, especially on greasy/oily, starchy and highly colored stains and soils. Preferably, the phospholipase and amylase, when present, are incorporated into the compositions of the present invention at a pure enzyme weight ratio between 4500:1 and 1:5, more preferably between 50:1 and 1:1.

Suitable proteases are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. Suitable is the protease called herein "Protease C", which is a variant of an alkaline serine protease from Bacillus in which Lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase as described in U.S. Pat. No. 5,677,272, and WO95/10591. Also suitable is a carbonyl hydrolase variant of the protease described in WO95/10591, having an amino acid sequence derived by replacement of a plurality of amino acid residues replaced in the precursor enzyme corresponding to position +210 in combination with one or more of the following residues : +33, +62, +67, +76, +100, +101, +103, +104, +107, +128, +129, +130, +132, +135, +156, +158, +164, +166, +167, +170, +209, +215, +217, +218, and +222, where the numbered position corresponds to naturally-occurring subtilisin from *Bacillus amyloliquefaciens* or to equivalent amino acid residues in other carbonyl hydrolases or subtilisins, such as *Bacillus lentus* subtilisin (co-pending patent application U.S. Serial No. 60/048,550, filed Jun. 4, 1997 and PCT International Application Serial No. PCT/IB98/00853).

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Particularly useful proteases are described in PCT publications: WO 95/30010; WO 95/30011; and WO 95/29979. Suitable proteases are commercially available as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

Other particularly useful proteases are multiply-substituted protease variants comprising a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillus amyloliquefaciens* subtilisin as described in PCT Application Nos. PCT/US98/22588, PCT/US98/22482 and PCT/US98/22486 all filed on Oct. 23, 1998 from The Procter & Gamble Company (P&G Cases 7280&, 7281& and 7282L, respectively). More preferably the protease variant includes a substitution set selected from the group consisting of:

12/76/103/104/130/222/245/261;

62/103/104/159/232/236/245/248/252;

62/103/104/159/213/232/236/245/248/252;

62/101/103/104/159/212/213/232/236/245/248/252;

68/103/104/159/232/236/245;

68/103/104/159/230/232/236/245;

68/103/104/159/209/232/236/245;

68/103/104/159/232/236/245/257;

68/76/103/104/159/213/232/236/245/260;

68/103/104/159/213/232/236/245/248/252;

68/103/104/159/183/232/236/245/248/252;

68/103/104/159/185/232/236/245/248/252;

68/103/104/159/185/210/232/2361245/248/252;

68/103/104/159/210/232/236/245/248/252;

68/103/104/159/213/232/236/245;

98/103/104/159/232/236/245/248/252;

98/102/103/104/159/212/232/236/245/248/252;

103/104/159/232/236/245/248/252;

102/103/104/1 59/232/236/245/248/252;

103/104/159/230/236/245;

103/104/159/232/236/245/248/252;

103/104/159/217/232/236/245/248/252;

103/104/130/159/232/236/245/248/252;

103/104/131/159/232/236/245/248/252;

103/104/159/213/232/236/245/248/252; and

103/104/159/232/236/245.

Still even more preferably the protease variant includes a substitution set selected from the group consisting of:

12R/76D/103A/104T/130T/222S/245R/261D;

62D/103A/104I/159D/232V/236H/245R/248D/252K;

62D/103A/104I/159D/213R/232V/236H/245R/248D/252K;

68A/103A/104I/159D/209W/232V/236H/245R;

68A/76D/103A/104I/159D/213R/232V/236H/245R/260A;

68A/103A/104I/159D/213E/232V/236H/245R/248D/252K;

68A/103A/104I/159D/183D/232V/236H/245R/248D/252K;

68A/103A/104I/159D/232V/236H/245R;

68A/103A/104I/159D/230V/232V/236H/245R;

68A/103A/104I/159D/232V/236H/245R/257V;

68A/103A/104I/159D/213G/232V/236H/245R/248D/252K;

68A/103A/104I/159D/185D/232V/236H/245R/248D/252K;

68A/103A/104I/159D/185D/210L/232V/236H/245R/248D/252K;

68A/103A/104I/159D/210L/232V/236H/245R/248D/252K;

68A/103A/104I/159D/213G/232V/236H/245R;

98L/103A/104I/159D/232V/236H/245R/248D/252K;

98L/102A/103A/104I/159D/212G/232V/236H/245R/248D/252K;

101G/103A/104I/159D/232V/236H/245R/248D/252K;

102A/103A/104I/159D/232V/236H/245R/248D/252K;

103A/104I/159D/230V/236H/245R;

103A/104I/159D/232V/236H/245R/248D/252K;

103A/104I/159D/217E/232V/236H/245R/248D/252K;

103A/104I/130G/159D/232V/236H/245R/248D/252K;

103A/104I/131 V/159D/232V/236H/245R/248D/252K;

103A/104I/159D/213R/232V/236H/245R/248D/252K.

Such amylolytic enzymes, when present, are incorporated in the cleaning compositions of the present invention a level of from 0.0001% to 2%, preferably from 0.00018% to 0.06%, more preferably from 0.00024% to 0.048% pure enzyme by weight of the composition.

The compositions of the present invention may also comprise a mannanase enzyme. Preferably, the mannanase is selected from the group consisting of: three mannans-degrading enzymes: EC 3.2.1.25: β-mannosidase, EC 3.2.1.78: Endo-1,4-β-mannosidase, referred therein after as "mannanase" and EC 3.2.1.100: 1,4-β-mannobiosidase and mixtures thereof (IUPAC Classification—Enzyme nomenclature, 1992 ISBN 0-12-227165-3 Academic Press).

More preferably, the treating compositions of the present invention, when a mannanase is present, comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalyzing the reaction: random hydrolysis of 1,4-beta-D-mannosidic linkages in mannans, galactomannans, glucomannans, and galactoglucomannans.

In particular, Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactogluco-mannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The degradation of galactomannans and galactoglucomannans is facilitated by full or partial removal of the galactose sidebranches. Further the degradation of the acetylated mannans, glucomannans, galactomannans and galactogluco-mannans is facilitated by full or partial deacetylation. Acetyl groups can be removed by alkali or by mannan acetylesterases. The oligomers which are released from the mannanases or by a combination of mannanases and α-galactosidase and/or mannan acetyl esterases can be further degraded to release free maltose by β-mannosidase and/or β-glucosidase.

Mannanases have been identified in several Bacillus organisms. For example, Talbot et al., Appl. Environ. Microbiol., Vol.56, No. 11, pp. 3505–3510 (1990) describes a beta-mannanase derived from *Bacillus stearothermophilus* in dimer form having molecular weight of 162 kDa and an optimum pH of 5.5–7.5. Mendoza et al., World J. Microbiol. Biotech., Vol. 10, No. 5, pp. 551–555 (1994) describes a beta-mannanase derived from *Bacillus subtilis* having a molecular weight of 38 kDa, an optimum activity at pH 5.0 and 55C and a pI of 4.8. JP-03047076 discloses a beta-mannanase derived from Bacillus sp., having a molecular weight of 373 kDa measured by gel filtration, an optimum pH of 8–10 and a pI of 5.3–5.4. JP-63056289 describes the production of an alkaline, thermostable beta-mannanase which hydrolyses beta-1,4-D-mannopyranoside bonds of e.g. mannans and produces manno-oligosaccharides. JP-63036774 relates to the Bacillus microorganism FERM P-8856 which produces beta-mannanase and beta-mannosidase at an alkaline pH. JP-08051975 discloses alkaline beta-mannanases from alkalophilic Bacillus sp. AM-001. A purified mannanase from *Bacillus amyloliquefaciens* useful in the bleaching of pulp and paper and a method of preparation thereof is disclosed in WO 97/11164. WO 91/18974 describes a hemicellulase such as a glucanase, xylanase or mannanase active at an extreme pH and temperature. WO 94/25576 discloses an enzyme from *Aspergillus aculeatus*, CBS 101.43, exhibiting mannanase activity which may be useful for degradation or modification of plant or algae cell wall material. WO 93/24622 discloses a mannanase isolated from *Trichoderma reseei* useful for bleaching lignocellulosic pulps. An hemicellulase capable of degrading mannan-containing hemicellulose is described in WO91/18974 and a purified mannase from *Bacillus amyloliquefaciens* is described in WO97/11164.

Preferably, the mannanase enzyme will be an alkaline mannanase as defined below, more preferably, a mannanase originating from a bacterial source. Especially, the laundry detergent composition of the present invention will comprise an alkaline mannanase selected from the mannanase from the strain *Bacillus agaradhaerens* NICMB 40482; the mannanase from *Bacillus subtilis* strain 168, gene yght; the mannanase from Bacillus sp. I633 and/or the mannanase from Bacillus sp. AAI12. Most preferred mannanase for the inclusion in the detergent compositions of the present invention is the mannanase enzyme originating from Bacillus sp. I633 as described in the co-pending Danish patent application No. PA 1998 01340.

The terms "alkaline mannanase enzyme" is meant to encompass an enzyme having an enzymatic activity of at least 10%, preferably at least 25%, more preferably at least 40% of its maximum activity at a given pH ranging from 7 to 12, preferably 7.5 to 10.5.

The alkaline mannanase from *Bacillus agaradhaerens* NICMB 40482 is described in the co-pending U.S. patent application Ser. No. 09/111,256. More specifically, this mannanase is:

i) a polypeptide produced by *Bacillus agaradhaerens*, NCIMB 40482; or ii) a polypeptide comprising an amino acid sequence as shown in positions 32–343 of SEQ ID NO:2 as shown in U.S. patent application Ser. No. 09/111,256; or iii) an analogue of the polypeptide defined in i) or ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed is the corresponding isolated polypeptide having mannanase activity selected from the group consisting of:

(a) polynucleotide molecules encoding a polypeptide having mannanase activity and comprising a sequence of nucleotides as shown in SEQ ID NO: 1 from nucleotide 97 to nucleotide 1029 as shown in U.S. patent application Ser. No. 09/111,256;

(b) species homologs of (a);

(c) polynucleotide molecules that encode a polypeptide having mannase activity that is at least 70% identical to the amino acid sequence of SEQ ID NO: 2 from amino acid residue 32 to amino acid residue 343 as shown in U.S. patent application Ser. No. 09/111,256;

(d) molecules complementary to (a), (b) or (c); and (e) degenerate nucleotide sequences of (a), (b), (c) or (d).

The plasmid pSJ1678 comprising the polynucleotide molecule (the DNA sequence) encoding said mannanase has been transformed into a strain of the *Escherichia coli* which was deposited by the inventors according to the Budapest Treaty on the International Recognition of the Deposit of Microorganisms for the Purposes of Patent Procedure at the Deutsche Sammlung von Milroorganismen und Zellkulturen GmbH, Mascheroder Weg 1b, D-38124 Braunschweig, Federal Republic of Germany, on May 18, 1998 under the deposition number DSM 12180.

A second more preferred enzyme is the mannanase from the *Bacillus subtilis* strain 168, which is described in the co-pending U.S. patent application Ser. No. 09/095,163. More specifically, this mannanase is:

i) is encoded by the coding part of the DNA sequence shown in SEQ ID No. 5 shown in the U.S. patent application Ser. No. 09/095,163 or an analogue of said sequence; and/or ii) a polypeptide comprising an amino acid sequence as shown SEQ ID NO:6 shown in the U.S. patent application Ser. No. 09/095,163; or iii) an analogue of the polypeptide defined in ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed in the corresponding isolated polypeptide having mannanase activity selected from the group consisting of:

(a) polynucleotide molecules encoding a polypeptide having mannanase activity and comprising a sequence of nucleotides as shown in SEQ ID NO:5 as shown in the U.S. patent application Ser. No. 09/095,163

(b) species homologs of (a);

(c) polynucleotide molecules that encode a polypeptide having mannanase activity that is at least 70% identical to the amino acid sequence of SEQ ID NO: 6 as shown in the U.S. patent application Ser. No. 09/095,163;

(d) molecules complementary to (a), (b) or (c); and (e) degenerate nucleotide sequences of (a), (b), (c) or (d).

A third more preferred mannanase is described in the co-pending Danish patent application No. PA 1998 01340. More specifically, this mannanase is:

i) a polypeptide produced by Bacillus sp. 1633;

ii) a polypeptide comprising an amino acid sequence as shown in positions 33–340 of SEQ ID NO:2 as shown in the Danish application No. PA 1998 01340; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

(a) polynucleotide molecules encoding a polypeptide having mannanase activity and comprising a sequence of nucleotides as shown in SEQ ID NO: 1 from nucleotide 317 to nucleotide 1243 the Danish application No. PA 1998 01340;

(b) species homologs of (a);

(c) polynucleotide molecules that encode a polypeptide having mannanase activity that is at least 65% identical to the amino acid sequence of SEQ ID NO: 2 from amino acid residue 33 to amino acid residue 340 the Danish application No. PA 1998 01340;

(d) molecules complementary to (a), (b) or (c); and (e) degenerate nucleotide sequences of (a), (b), (c) or (d).

The plasmid pBXM3 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 29, 1998 under the deposition number DSM 12197.

A fourth more preferred mannanase is described in the Danish co-pending patent application No. PA 1998 01341. More specifically, this mannanase is:

i) a polypeptide produced by Bacillus sp. AAI 12;

ii) a polypeptide comprising an amino acid sequence as shown in positions 25–362 of SEQ ID NO:2 as shown in the Danish application No. PA 1998 01341; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of (a) polynucleotide molecules encoding a polypeptide having mannanase activity and comprising a sequence of nucleotides as shown in SEQ ID NO: 1 from nucleotide 225 to nucleotide 1236 as shown in the Danish application No. PA 1998 01341;

(b) species homologs of (a);

(c) polynucleotide molecules that encode a polypeptide having mannanase activity that is at least 65% identical to the amino acid sequence of SEQ ID NO: 2 from amino acid residue 25 to amino acid residue 362 as shown in the Danish application No. PA 1998 01341;

(d) molecules complementary to (a), (b) or (c); and (e) degenerate nucleotide sequences of (a), (b), (c) or (d).

The plasmid pBXM1 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on Oct. 7, 1998 under the deposition number DSM 12433.

The mannanase, when present, is incorporated into the treating compositions of the present invention preferably at a level of from 0.0001% to 2%, more preferably from 0.0005% to 0.1%, most preferred from 0.001% to 0.02% pure enzyme by weight of the composition.

The compositions of the present invention may also comprise a xyloglucanase enzyme. Suitable xyloglucanases for the purpose of the present invention are enzymes exhibiting endoglucanase activity specific for xyloglucan, preferably at a level of from about 0.001% to about 1%, more preferably from about 0.01% to about 0.5%, by weight of the composition. As used herein, the term "endoglucanase activity" means the capability of the enzyme to hydrolyze 1,4-β-D-glycosidic linkages present in any cellulosic material, such as cellulose, cellulose derivatives, lichenin, β-D-glucan, or xyloglucan. The endoglucanase activity may be determined in accordance with methods known in the art, examples of which are described in WO 94/14953 and hereinafter. One unit of endoglucanase activity (e.g. CMCU, AVIU, XGU or BGU) is defined as the production of 1 μmol reducing sugar/min from a glucan substrate, the glucan substrate being, e.g., CMC (CMCU), acid swollen Avicell (AVIU), xyloglucan (XGU) or cereal β-glucan (BGU). The reducing sugars are determined as described in WO 94/14953 and hereinafter. The specific activity of an endoglucanase towards a substrate is defined as units/mg of protein.

Suitable are enzymes exhibiting as its highest activity XGU endoglucanase activity (hereinafter "specific for xyloglucan"), which enzyme:

i) is encoded by a DNA sequence comprising or included in at least one of the following partial sequences (a) ATTCATTTGT GGACAGTGGA C (SEQ ID No: 1)
(b) GTTGATCGCA CATTGAACCA (SEQ ID NO: 2)
(c) ACCCCAGCCG ACCGATTGTC (SEQ ID NO: 3)
(d) CTTCCTTACC TCACCATCAT (SEQ ID NO: 4)
(e) TTAACATCTT TTCACCATGA (SEQ ID NO: 5)
(f) AGCTTTCCCT TCTCTCCCTT (SEQ ID NO: 6)
(g) GCCACCCTGG CTTCCGCTGC CAGCCTCC (SEQ ID NO: 7)
(h) GACAGTAGCA ATCCAGCATT (SEQ ID NO: 8)
(i) AGCATCAGCC GCTTTGTACA (SEQ ID NO: 9)
(j) CCATGAAGTT CACCGTATTG (SEQ ID NO: 10)
(k) GCACTGCTTC TCTCCCAGGT (SEQ ID NO: 11)
(l) GTGGGCGGCC CCTCAGGCAA (SEQ ID NO: 12)
(m) ACGCTCCTCC AATTTTCTCT (SEQ ID NO: 13)
(n) GGCTGGTAG TAATGAGTCT (SEQ ID NO: 14)
(o) GGCGCAGAGT TTGGCCAGGC (SEQ ID NO: 15)
(p) CAACATCCCC GGTGTTCTGG G (SEQ ID NO: 16)
(q) AAAGATTCAT TTGTGGACAG TGGACGTRGA TCGCACATTG AACCAACCCC AGCCGACCGA TTGTCCTTCC TTACCTCACC ATCATTTAAC ATCTTTTCAC CATGAAGCTT TCCCTTCTCT CCCTTGCCAC CCTGGCTTCC GCTGCCAGCC TCCAGCGCCG CACACTTCTG CGGTCAGTGG GATACCGCCA CCGCCGGTGA CTCACCCTG TACAACGACC TTTGGGGCGA GACGGCCGGC ACCGGCTCCC AGTGCACTGG AGTCGACTCC TACAGCGGCG ACACCATCGC TTGTCACACC AGCAGGTCCT GGTCGGAGTA GCAGCAGCGT CAAGAGCTAT GCCAACG (SEQ ID NO:17) or (r) CAGCATCTCC ATTGAGTAAT CACGTTGGTG TTCGGTGGCC CGCCGTGTTG CGTGGCGGAG GCTGCCGGGA GACGGGTGGG GATGGTGGTG GGAGAGAATG TAGGGCGCCG TGTTTCAGTC CCTAGGCAGG ATACCGGAAA ACCGTGTGGT AGGAGGTTTA TAGGTTTCCA GGAGACGCTG TATAGGGGAT AAATGAGATT GAATGGTGGC CACACTCAAA CCAACCAGGT CCTGTACATA CAATGCATAT ACCAATTATA CCTACCAAAA AAAAAAAAAA AAAAAAAAAA AAAA (SEQ ID NO:18)

or a sequence homologous thereto encoding a polypeptide specific for xyloglucan with endoglucanase activity, ii) is immunologically reactive with an antibody raised against a highly purified endoglucanase encoded by the DNA sequence defined in i) and derived from *Aspergillus aculeatus*, CBS 101.43, and is specific for xyloglucan.

More specifically, as used herein the term "specific for xyloglucan" means that the endoglucanase enzyme exhibits its highest endoglucanase activity on a xyloglucan substrate, and preferably less than 75% activity, more preferably less than 50% activity, most preferably less than about 25% activity, on other cellulose-containing substrates such as carboxymethyl cellulose, cellulose, or other glucans.

Preferably, the specificity of an endoglucanase towards xyloglucan is further defined as a relative activity determined as the release of reducing sugars at optimal conditions obtained by incubation of the enzyme with xyloglucan and the other substrate to be tested, respectively. For instance, the specificity may be defined as the xyloglucan to β-glucan activity (XGU/BGU), xyloglucan to carboxy methyl cellulose activity (XGU/CMCU), or xyloglucan to acid swollen Avicell activity (XGU/AVIU), which is preferably greater than about 50, such as 75, 90 or 100.

The term "derived from" as used herein refers not only to an endoglucanase produced by strain CBS 101.43, but also an endoglucanase encoded by a DNA sequence isolated from strain CBS 101.43 and produced in a host organism transformed with said DNA sequence. The term "homologue" as used herein indicates a polypeptide encoded by DNA which hybridizes to the same probe as the DNA coding for an endoglucanase enzyme specific for xyloglucan under certain specified conditions (such as presoaking in 5×SSC and prehybridizing for 1 h at −40° C. in a solution of 5×SSC, 5×Denhardt's solution, and 50 μg of denatured sonicated calf thymus DNA, followed by hybridization in the same solution supplemented with 50 μCi 32-P-dCTP labelled probe for 18 h at −40° C. and washing three times in 2×SSC, 0.2% SDS at 40° C. for 30 minutes). More specifically, the term is intended to refer to a DNA sequence which is at least 70% homologous to any of the sequences shown above encoding an endoglucanase specific for xyloglucan, including at least 75%, at least 80%, at least 85%, at least 90% or even at least 95% with any of the sequences shown above. The term is intended to include modifications of any of the DNA sequences shown above, such as nucleotide substitutions which do not give rise to another amino acid sequence of the polypeptide encoded by the sequence, but which correspond to the codon usage of the host organism into which a DNA construct comprising any of the DNA sequences is introduced or nucleotide substitutions which do give rise to a different amino acid sequence and therefore, possibly, a different amino acid sequence and therefore, possibly, a different protein structure which might give rise to an endoglucanase mutant with different properties than the native enzyme. Other examples of possible modifications are insertion of one or more nucleotides into the sequence, addition of one or more nucleotides at either end of the sequence, or deletion of one or more nucleotides at either end or within the sequence.

Endoglucanase specific for xyloglucan useful in the present invention preferably is one which has a XGU/BGU, XGU/CMU and/or XGU/AVIU ratio (as defined above) of more than 50, such as 75, 90 or 100.

Furthermore, the endoglucanase specific for xyloglucan is preferably substantially devoid of activity towards β-glucan and/or exhibits at the most 25% such as at the most 10% or about 5%, activity towards carboxymethyl cellulose and/or Avicell when the activity towards xyloglucan is 100%. In addition, endoglucanase specific for xyloglucan of the invention is preferably substantially devoid of transferase activity, an activity which has been observed for most endoglucanases specific for xyloglucan of plant origin.

Endoglucanase specific for xyloglucan may be obtained from the fungal species *A. aculeatus*, as described in WO 94/14953. Microbial endoglucanases specific for xyloglucan has also been described in WO 94/14953. Endoglucanases specific for xyloglucan from plants have been described, but these enzymes have transferase activity and therefore must be considered inferior to microbial endoglucanases specific for xyloglucan whenever extensive degradation of xyloglucan is desirable. An additional advantage of a microbial enzyme is that it, in general, may be produced in higher amounts in a microbial host, than enzymes of other origins.

The xyloglucanase, when present, is incorporated into the treating compositions of the invention preferably at a level of from 0.0001% to 2%, more preferably from 0.0005% to 0.1%, most preferred from 0.001% to 0.02% pure enzyme by weight of the composition.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Nowadays, it is common practice to modify wild-type enzymes via protein/genetic engineering techniques in order to optimize their performance efficiency in the treating compositions of the invention. For example, the variants may be designed such that the compatibility of the enzyme to commonly encountered ingredients of such compositions is increased. Alternatively, the variant may be designed such that the optimal pH, bleach or chelant stability, catalytic activity and the like, of the enzyme variant is tailored to suit the particular cleaning application.

In particular, attention should be focused on amino acids sensitive to oxidation in the case of bleach stability and on surface charges for the surfactant compatibility. The isoelectric point of such enzymes may be modified by the substitution of some charged amino acids, e.g. an increase in isoelectric point may help to improve compatibility with anionic surfactants. The stability of the enzymes may be further enhanced by the creation of e.g. additional salt bridges and enforcing calcium binding sites to increase chelant stability.

These optional detersive enzymes, when present, are normally incorporated in the treating composition at levels from 0.0001% to 2% of pure enzyme by weight of the treating composition. The enzymes can be added as separate single ingredients (prills, granulates, stabilized liquids, etc . . . containing one enzyme) or as mixtures of two or more enzymes ( e.g. cogranulates).

Other suitable cleaning adjunct materials that can be added are enzyme oxidation scavengers. Examples of such enzyme oxidation scavengers are ethoxylated tetraethylene polyamines.

A range of enzyme materials and means for their incorporation into synthetic detergent compositions is also disclosed in WO 9307263 and WO 9307260 to Genencor International, WO 8908694, and U.S. Pat. No. 3,553,139, Jan. 5, 1971 to McCarty et al. Enzymes are further disclosed in U.S. Pat. No. 4,101,457, and in U.S. Pat. No. 4,507,219. Enzyme materials useful for liquid detergent formulations, and their incorporation into such formulations, are disclosed in U.S. Pat. No. 4,261,868.

Enzyme Stabilizers—Enzymes for use in treating compositions can be stabilized by various techniques. Enzyme stabilization techniques are disclosed and exemplified in U.S. Pat. No. 3,600,319, EP 199,405 and EP 200,586. Enzyme stabilization systems are also described, for example, in U.S. Pat. No. 3,519,570. A useful Bacillus, sp. AC13 giving proteases, xylanases and cellulases, is described in WO 9401532. The enzymes employed herein can be stabilized by the presence of water-soluble sources of calcium and/or magnesium ions in the finished compositions which provide such ions to the enzymes. Suitable enzyme stabilizers and levels of use are described in U.S. Pat. Nos. 5,705,464, 5,710,115 and 5,576,282.

Builders—The treating compositions described herein preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder. Lower or higher levels of builder, however, are not meant to be excluded.

Preferred builders for use in the treating compositions, particularly dishwashing compositions, described herein include, but are not limited to, water-soluble builder compounds, (for example polycarboxylates) as described in U.S. Pat. Nos. 5,695,679, 5,705,464 and 5,710,115. Other suitable polycarboxylates are disclosed in U.S. Pat. Nos. 4,144,226, 3,308,067 and 3,723,322. Preferred polycarboxylates are hydroxycarboxylates containing up to three carboxy groups per molecule, more particularly titrates.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates (see, for example, U.S. Pat. Nos. 3,159,581; 3,213,030; 3,422,021; 3,400,148 and 3,422,137), phytic acid, silicates, carbonates (including bicarbonates and sesquicarbonates), sulphates, and aluminosilicates.

However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Suitable silicates include the water-soluble sodium silicates with an $SiO_2$:$Na_2O$ ratio of from about 1.0 to 2.8, with ratios of from about 1.6 to 2.4 being preferred, and about 2.0 ratio being most preferred. The silicates may be in the form of either the anhydrous salt or a hydrated salt. Sodium silicate with an $SiO_2$:$Na_2O$ ratio of 2.0 is the most preferred. Silicates, when present, are preferably present in the treating compositions described herein at a level of from about 5% to about 50% by weight of the composition, more preferably from about 10% to about 40% by weight.

Partially soluble or insoluble builder compounds, which are suitable for use in the treating compositions, particularly granular detergent compositions, include, but are not limited to, crystalline layered silicates, preferably crystalline layered sodium silicates (partially water-soluble) as described in U.S. Pat. No. 4,664,839, and sodium aluminosilicates (water-insoluble). When present in treating compositions, these builders are typically present at a level of from about 1% to 80% by weight, preferably from about 10% to 70% by weight, most preferably from about 20% to 60% by weight of the composition.

Crystalline layered sodium silicates having the general formula $NaMSi_xO_{2x+1}.yH_2O$ wherein M is sodium or hydrogen, x is a number from about 1.9 to about 4, preferably from about 2 to about 4, most preferably 2, and y is a number from about 0 to about 20, preferably 0 can be used in the compositions described herein. Crystalline layered sodium silicates of this type are disclosed in EP-A-0164514 and methods for their preparation are disclosed in DE-A-3417649 and DE-A-3742043. The most preferred material is delta-$Na_2SiO_5$, available from Hoechst AG as NaSKS-6 (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. SKS-6 is a highly preferred layered silicate for use in the compositions described herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used in the compositions described herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

The crystalline layered sodium silicate material is preferably present in granular detergent compositions as a particulate in intimate admixture with a solid, water-soluble ionizable material. The solid, water-soluble ionizable material is preferably selected from organic acids, organic and inorganic acid salts and mixtures thereof.

Aluminosilicate builders are of great importance in most currently marketed heavy duty granular detergent compositions, and can also be a significant builder ingredient in liquid detergent formulations. Aluminosilicate builders have the empirical formula:

$$[M_z(AlO_2)_y].xH_2O$$

wherein z and y are integers of at least 6, the molar ratio of z to y is in the range from 1.0 to about 0.5, and x is an integer from about 15 to about 264. Preferably, the aluminosilicate builder is an aluminosilicate zeolite having the unit cell formula:

$$Na_z[(AlO_2)_z(SiO_2)_y].xH_2O$$

wherein z and y are at least 6; the molar ratio of z to y is from 1.0 to 0.5 and x is at least 5, preferably 7.5 to 276, more preferably from 10 to 264. The aluminosilicate builders are preferably in hydrated form and are preferably crystalline, containing from about 10% to about 28%, more preferably from about 18% to about 22% water in bound form.

These aluminosilicate ion exchange materials can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite B, Zeolite P, Zeolite X, Zeolite AX, Zeolite MAP and Zeolite HS and mixtures thereof. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. Zeolite X has the formula:

$$Na_{86}[(AlO_2)_{86}(SiO_2)_{106}].276H_2O$$

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions described herein are the 3,3-dicarboxy oxa-1,6-hexanedioates and the related compounds disclosed in U.S. Pat. No. 4,566,984. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Dispersants—One or more suitable polyalkyleneimine dispersants may be incorporated into the treating compositions of the present invention. Examples of such suitable dispersants can be found in European Patent Application Nos. 111,965, 111,984, and 112,592; U.S. Pat. Nos. 4,597,898, 4,548,744, and 5,565,145. However, any suitable clay/soil dispersent or anti-redepostion agent can be used in the treating compositions of the present invention.

In addition, polymeric dispersing agents which include polymeric polycarboxylates and polyethylene glycols, are suitable for use in the present invention. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents—The treating compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Nonlimiting examples of suitable soil release polymers are disclosed in: U.S. Pat. Nos. 5,728,671; 5,691,298; 5,599,782; 5,415,807; 5,182,043; 4,956,447; 4,976,879; 4,968,451; 4,925,577; 4,861,512; 4,877,896; 4,771,730; 4,711,730; 4,721,580; 4,000,093; 3,959,230; and 3,893,929; and European Patent Application 0 219 048.

Further suitable soil release agents are described in U.S. Pat. Nos. 4,201,824; 4,240,918; 4,525,524; 4,579,681; 4,220,918; and 4,787,989; EP 279,134 A; EP 457,205 A; and DE 2,335,044.

Chelating Agents—The treating compositions of the present invention herein may also optionally contain a chelating agent which serves to chelate metal ions and metal impurities which would otherwise tend to deactivate the bleaching agent(s). Useful chelating agents can include amino carboxylates, phosphonates, amino phosphonates, polyfunctionally-substituted aromatic chelating agents and mixtures thereof. Further examples of suitable chelating agents and levels of use are described in U.S. Pat. Nos. 5,705,464, 5,710,115, 5,728,671 and 5,576,282.

The compositions herein may also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% to about 15%, more preferably from about 0.1% to about 3.0% by weight of the treating compositions herein.

Suds suppressor—Another optional ingredient is a suds suppressor, exemplified by silicones, and silica-silicone mixtures. Examples of suitable suds suppressors are disclosed in U.S. Pat. Nos. 5,707,950 and 5,728,671. These suds suppressors are normally employed at levels of from 0.001% to 2% by weight of the composition, preferably from 0.01% to 1% by weight.

Softening agents—Fabric softening agents can also be incorporated into the treating compositions of the present invention. Inorganic softening agents are exemplified by the smectite clays disclosed in GB-A-1 400 898 and in U.S. Pat. No. 5,019,292. Organic softening agents include the water insoluble tertiary amines as disclosed in GB-A-1 514 276 and EP-B-011 340 and their combination with mono C12–C14 quaternary ammonium salts are disclosed in EP-B-026 527 and EP-B-026 528 and di-long-chain amides as disclosed in EP-B-0 242 919. Other useful organic ingredients of fabric softening systems include high molecular weight polyethylene oxide materials as disclosed in EP-A-0 299 575 and 0 313 146.

Particularly suitable fabric softening agents are disclosed in U.S. Pat. Nos. 5,707,950 and 5,728,673.

Levels of smectite clay are normally in the range from 2% to 20%, more preferably from 5% to 15% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight whilst the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Biodegradable quaternary ammonium compounds as described in EP-A-040 562 and EP-A-239 910 have been presented as alternatives to the traditionally used di-long alkyl chain ammonium chlorides and methyl sulfates.

Non-limiting examples of softener-compatible anions for the quaternary ammonium compounds and amine precursors include chloride or methyl sulfate.

Due transfer inhibition—The treating compositions of the present invention can also include compounds for inhibiting dye transfer from one fabric to another of solubilized and suspended dyes encountered during fabric laundering and conditioning operations involving colored fabrics.

Polymeric Dye Transfer Inhibiting Agents

The treating compositions according to the present invention can also comprise from 0.001% to 10%, preferably from 0.01% to 2%, more preferably from 0.05% to 1% by weight of polymeric dye transfer inhibiting agents. Said polymeric dye transfer inhibiting agents are normally incorporated into treating compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash.

Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof. Examples of such dye transfer inhibiting agents are disclosed in U.S. Pat. Nos. 5,707,950 and 5,707,951.

Additional suitable dye transfer inhibiting agents include, but are not limited to, cross-linked polymers. Cross-linked polymers are polymers whose backbone are interconnected to a certain degree; these links can be of chemical or physical nature, possibly with active groups n the backbone or on branches; cross-linked polymers have been described in the Journal of Polymer Science, volume 22, pages 1035–1039.

In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling. Such cross-linked polymers are described in the co-pending European patent application 94870213.9.

Addition of such polymers also enhances the performance of the enzymes according the invention.

Hydrogen Bond Breaking Agents—Suitable hydrogen bond breaking agents including, but not limited to, plant expansin and urea can optionally be incorporated into the treating compositions of the present invention.

pH and Buffering Variation—Many of the treating compositions described herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

Other Materials—Other cleaning adjunct materials optionally included in the treating compositions of the present invention can include one or more materials for assisting or enhancing cleaning performance, treatment of the substrate to be cleaned, or designed to improve the aesthetics of the compositions. Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as clay soil removal/anti-redeposition agents, brighteners, dyes, perfumes, structure elasticizing agents, carriers, hydrotropes, processing aids, fillers, germicides, alkalinity sources, solubilizing agents and/or pigments. Suitable examples of such other cleaning adjunct materials and levels of use are found in U.S. Pat. Nos. 5,576,282, 5,705,464, 5,710,115, 5,698,504, 5,695,679, 5,686,014 and 5,646,101.

The following examples are meant to exemplify compositions of the present invention, but are not necessarily meant to limit or otherwise define the scope of the invention. In the treating compositions, the enzyme levels are expressed by percent of pure enzyme by weight of the total composition and unless otherwise specified, the cleaning adjunct materials are expressed as percent of cleaning adjunct materials by weight of the total compositions. The polysaccharides can be any suitable polysaccharide disclosed hereinabove.

Further, in the following examples some abbreviations known to those of ordinary skill in the art are used, consistent with the disclosure set forth herein, and/or are defined in below.

| | |
|---|---|
| LAS | Sodium linear $C_{12}$ alkyl benzene sulphonate |
| TAS | Sodium tallow alkyl sulphate |
| CXYAS | Sodium $C_{1X}$–$C_{1Y}$ alkyl sulfate |
| 25EY | A $C_{12}$–$C_{15}$ predominantly linear primary alcohol condensed with an average of Y moles of ethylene oxide |
| CXYEZ | A $C_{1X}$–$C_{1Y}$ predominantly linear primary alcohol condensed with an average of Z moles of ethylene oxide |
| XYEZS | $C_{1X}$–$C_{1Y}$ sodium alkyl sulfate condensed with an average of Z moles of ethylene oxide per mole |
| QAS | $R_2.N^+(CH_3)_2(C_2H_4OH)$ with $R_2 = C_{12}$–$C_{14}$ |
| Soap | Sodium linear alkyl carboxylate derived from a 80/20 mixture of tallow and coconut oils. |
| Nonionic | $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF Gmbh. |
| CFAA | $C_{12}$–$C_{14}$ alkyl N-methyl glucamide |
| TFAA | $C_{16}$–$C_{18}$ alkyl N-methyl glucamide |
| TPKFA | C12–C14 topped whole cut fatty acids. |
| DEQA | Di-(tallow-oxy-ethyl) dimethyl ammonium chloride. |
| Neodol 45-13 | C14–C15 linear primary alcohol ethoxylate, sold by Shell Chemical CO. |
| Silicate | Amorphous Sodium Silicate ($SiO_2$:$Na_2O$ ratio = 2.0) |
| NaSKS-6 | Crystalline layered silicate of formula $\delta$-$Na_2Si_2O_5$. |
| Carbonate | Anhydrous sodium carbonate with a particle size between 200 $\mu$m and 900 $\mu$m. |
| Bicarbonate | Anhydrous sodium bicarbonate with a particle size between 400 $\mu$m and 1200 $\mu$m. |
| STPP | Anhydrous sodium tripolyphosphate |
| MA/AA | Copolymer of 1:4 maleic/acrylic acid, average molecular weight about 70,000–80,000 |
| Zeolite A | Hydrated Sodium Aluminosilicate of formula $Na_{12}(AlO_2SiO_2)_{12}$ $.27H_2O$ having a primary particle size in the range from 0.1 to 10 micrometers |
| Citrate | Tri-sodium citrate dihydrate of activity 86,4% with a particle size distribution between 425 $\mu$m and 850 $\mu$m. |
| Citric | Anhydrous citric acid |
| PB1 | Anhydrous sodium perborate monohydrate bleach, empirical formula $NaBO_2.H_2O_2$ |
| PB4 | Anhydrous sodium perborate tetrahydrate |
| Percarbonate | Anhydrous sodium percarbonate bleach of empirical formula $2Na_2CO_3.3H_2O_2$ |
| TAED | Tetraacetyl ethylene diamine. |
| NOBS | Nonanoyloxybenzene sulfonate in the form of the sodium salt. |
| Photoactivated Bleach | Sulfonated zinc phalocyanine encapsulated in dextrin soluble polymer. |
| Protease | Proteolytic enzyme described hereinbefore. |
| Amylase | Amlylolytic enzyme described hereinbefore. |
| Lipase | Lipolytic enzyme described hereinbefore. |
| Cellulase | Cellulytic enzyme described hereinbefore. |
| CMC | Sodium carboxymethyl cellulose. |
| HEDP | 1,1-hydroxyethane diphosphonic acid. |
| DETPMP | Diethylene triamine penta (methylene phosphonic acid), marketed by Monsanto under the Trade name Dequest 2060. |
| PVNO | Poly(4-vinylpyridine)-N-Oxide. |
| PVPVI | Poly(4-vinylpyridine)-N-oxide/copolymer of vinyl-imidazole and vinyl-pyrrolidone. |
| Brightener 1 | Disodium 4,4"-bis(2-sulphostyryl)biphenyl. |
| Brightener 2 | Disodium 4,4"-bis(anilino-6-morpholino-1.3.5-triazin-2-yl) stilbene-2:2"-sulfonate. |
| Silicone antifoam | Polydimethylsiloxane foam controller with siloxane-oxyalkylene copolymer as dispersing agent with a ratio of said foam controller to said dispersing agent of 10:1 to 100:1. |
| Granular Suds Suppressor | 12% Silicone/silica, 18% stearyl alcohol, 70% starch in granular form |
| SRP 1 | Sulfobenzoyl or sodium isethionate end capped esters with oxyethylene oxy and terephtaloyl backbone. |
| SRP 2 | Diethoxylated poly (1,2 propylene terephtalate) short block polymer. |
| Sulphate | Anhydrous sodium sulphate. |
| HMWPEO | High molecular weight polyethylene oxide |

EXAMPLE I

| Ingredients | Wt. % | | | | | |
|---|---|---|---|---|---|---|
| | Ia | Ib | Ic | Id | Ie | If |
| Polysaccharide | 0.5 | 1 | 0.2 | 0.5 | 0.5 | 0.5 |
| Volatile Perfume A[1] | — | — | — | 0.1 | — | — |
| Substantive Perfume B[2] | — | — | — | — | 0.03 | — |
| Hydrophilic Perfume C[3] | — | — | — | — | — | 0.05 |
| Poly-sorbate 60[4] | — | — | — | 0.2 | 0.1 | — |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

[1]Perfume contains mainly ingredients having a boiling point of less than about 250° C.
[2]Perfume contains mainly ingredients having a boiling point of about 250° C. or higher.
[3]Perfume contains mainly ingredients having a ClogP of about 3.0 or less.
[4]A mixture of stearate esters of sorbitol and sorbitol anhydride, consisting predominantly of the monoester, condensed with about 20 moles of ethylene oxide.

EXAMPLE II

| Ingredients | Wt. % | | | | | |
|---|---|---|---|---|---|---|
| | IIa | IIb | IIc | IId | IIe | IIf |
| Polysaccharide | 1 | 2 | 0.5 | 1 | 1 | 1 |
| Perfume A | — | — | — | — | 1 | — |
| Perfume B | — | — | — | 0.3 | — | — |
| Perfume C | — | — | — | — | — | 1.5 |
| Polysorbate 60 | — | — | — | 0.5 | 1.5 | 1 |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

Concentrated compositions of Examples II are diluted with water to obtain usage compositions for, e.g., spraying, soaking, dipping, cellulosic fabrics.

EXAMPLE III

| Ingredients | Wt. % | | | | |
|---|---|---|---|---|---|
| | IIIa | IIIb | IIIc | IIId | IIIe |
| Polysaccharide | 1 | 2 | 0.5 | 1 | 1 |
| LiBr | 3 | — | — | 2 | 2 |
| Silicone Emulsion[5] | — | 1.5 | — | — | 2.0 |
| D5 Volatile Silicone | — | — | 0.5 | 0.5 | — |
| Perfume A | — | — | — | — | 0.03 |
| Perfume B | — | — | — | 0.05 | — |
| Perfume C | 0.03 | — | — | — | — |
| Polysorbate 60 | — | — | — | 0.1 | 0.05 |
| Silwet L-7602 | — | — | — | 0.5 | — |
| Silwet L-7622 | — | — | — | — | 0.3 |
| Kathon CG | 3 ppm | 3 ppm | 3 ppm | 3 ppm | 3 ppm |
| Deionized Water | Bal. | Bal. | Bal. | Bal. | Bal. |

[5]DC-2-5932 silicone microemulsion (25% active) from Dow Corning, with a particle size of about 24 nm, a cationic surfactant system, and a silicone with an internal phase viscosity of about 1,200 cps.

EXAMPLE IV

| Ingredients | Wt. % | | | | | |
|---|---|---|---|---|---|---|
| | IVa | IVb | IVc | IVd | Ive | IVf |
| Polysaccharide | 1 | 2 | 0.5 | 1 | 1 | 0.5 |
| Copolymer A[6] | 0.4 | — | — | — | — | 0.5 |
| Copolymer B[7] | — | 0.5 | — | 0.3 | — | — |
| Copolymer C[8] | — | — | 0.6 | — | 0.5 | — |
| LiBr | — | — | — | 3 | — | 2 |
| Silicone Emulsion[5] | — | — | — | — | 1.5 | — |
| D5 Volatile Silicone | — | — | — | — | — | 0.5 |
| Perfume A | 0.06 | — | — | — | — | 0.07 |
| Perfume B | — | 0.03 | — | 0.03 | — | — |
| Perfume C | — | — | 0.04 | — | 0.03 | — |
| Polysorbate 60 | 0.1 | 0.1 | 0.03 | 0.1 | 0.1 | 0.1 |
| Silwet L-7600 | — | — | — | 0.5 | — | — |
| Silwet L-7602 | — | — | — | — | — | 0.7 |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

[5]DC-2-5932 silicone microemulsion (25% active) from Dow Corning, with a particle size of about 24 nm, a cationic surfactant system, and a silicone with an internal phase viscosity of about 1,200 cps.
[6]Acrylic acid/tert-butyl acrylate copolymer, with an approximate acrylic acid/tert-butyl acrylate weight ratio of about 25/75 and an average molecular weight of from about 70,000 to about 100,000.
[7]Acrylic acid/tert-butyl acrylate copolymer, with an approximate acrylic acid/tert-butyl acrylate weight ratio of about 35/65 and an average molecular weight of from about 60,000 to about 90,000.
[8]Acrylic acid/tert-butyl acrylate copolymer, with an approximate acrylic acid/tert-butyl acrylate weight ratio of about 20/80 and an average molecular weight of from about 80,000 to about 110,000.

EXAMPLE V

| Ingredients | Wt. % | | | | | |
|---|---|---|---|---|---|---|
| | Va | Vb | Vc | Vd | Ve | Vf |
| Polysaccharide | 1 | 2 | 0.5 | 1 | 1 | 0.5 |
| Copolymer D[9] | 0.4 | — | — | — | 2 | 0.25 |
| Copolymer E[10] | — | 0.5 | — | — | — | 0.25 |
| Copolymer F[11] | — | — | 0.4 | — | — | — |
| Copolymer G[12] | — | — | — | 0.5 | — | — |
| D5 Volatile Silicone | — | 0.25 | — | — | — | — |
| PDMS 10,000 cst | — | — | — | 0.3 | — | — |
| Silicone Emulsion B[13] | — | — | 1 | — | 2 | — |
| Perfume A | 0.06 | — | — | — | — | 0.07 |
| Perfume B | — | 0.03 | — | 0.03 | — | — |
| Perfume C | — | — | 0.04 | — | 0.5 | — |
| Polysorbate 60 | 0.1 | 0.1 | — | 0.1 | 0.5 | 0.1 |
| Neodol 23-3 | — | 0.25 | — | 0.2 | — | — |
| Neodol 25-3 | — | — | 0.3 | — | 0.3 | 0.25 |
| Silwet L-77 | — | 0.7 | — | 1 | — | — |
| Silwet L-7604 | — | — | 0.5 | — | — | 0.7 |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

[9]Acrylic acid/tert-butyl acrylate copolymer, with an approximate acrylic acid/tert-butyl acrylate weight ratio of about 23/77 and an average molecular weight of about 82,000.

-continued

| Ingredients | Wt. % | | | | | |
|---|---|---|---|---|---|---|
| | Va | Vb | Vc | Vd | Ve | Vf |

(10)Silicone-containing copolymer having t-butyl acrylate/acrylic acid/(polydimethylsiloxane macromer, 10,000 approximate molecular weight) monomer at an approximate 63/20/17 weight ratio, and of an average molecular weight of about 130,000.
(11)Silicone-containing copolymer having t-butyl acrylate/acrylic acid/(polydimethylsiloxane macromer, 10,000 approximate molecular weight) monomer at an approximate 65/25/10 weight ratio, and of average molecular weight of about 200,000.
(12)Silicone-containing copolymer having (N,N,N-trimethyiammonioethyl methacrylate chloride)/N,N-dimethylacrylamide/(PDMS macromer - 15,000 approximate molecular weight) at an approximate 40/40/20 weight ratio, and of average molecular weight of about 150,000.
(13)DC-1550 silicone microemulsion (25% active) from Dow Corning, with a particle size of about 50 nm, an anionic/nonionic surfactant system, and a silicone with an internal phase viscosity of about 100,000 cps.

The composition of Example Ve is a concentrated composition, to be diluted for use.

EXAMPLE VI

| Ingredients | Wt % | | | | | |
|---|---|---|---|---|---|---|
| | VIa | VIb | VIc | VId | VIe | VIf |
| Polysaccharide | 1 | 2 | 0.5 | 1 | 1 | 0.5 |
| HPBCD(14) | 1 | — | 0.5 | — | 0.5 | — |
| RAMEB(15) | — | 1 | — | — | — | — |
| HPACD(16) | — | — | 0.5 | — | — | — |
| α-Cyclodextrin | — | — | — | — | 0.5 | 0.5 |
| b-Cyclodextrin | — | — | — | 0.5 | — | 0.5 |
| $ZnCl_2$ | — | 1.0 | — | 1.0 | — | 1 |
| Silwet L-7657 | — | — | — | — | — | — |
| Perfume C | 0.1 | 0.07 | 0.05 | — | 0.1 | 0.05 |
| Propylene glycol | 0.06 | — | 0.05 | — | 0.03 | — |
| Kathon CG | 3 ppm | 3 ppm | 3 ppm | 3 ppm | 3 ppm | 3 ppm |
| HCl | — | to pH 4.5 | — | to pH 5 | — | to pH 4.5 |
| Distilled water | Bal. | Bal. | Bal. | Bal. | Bal. | Bal. |

(14)Hydroxypropyl beta-cyclodextrin.
(15)Randomly methylated beta-cyclodextrin.
(16)Hydroxypropyl alpha-cyclodextrin.

EXAMPLE VII

| Ingredients | Wt % | | | | | |
|---|---|---|---|---|---|---|
| | VIIa | VIIb | VIIc | VIId | VIIe | VIIf |
| Polysaccharide | 1 | 2 | 0.5 | 1 | 1 | 0.5 |
| HPBCD | 1.0 | — | — | — | — | — |
| RAMEB | — | 1.0 | — | — | — | — |
| Silwet L-7604 | 0.3 | 0.2 | 0.2 | — | — | 0.1 |
| Chlorhexidine | 0.01 | — | — | — | — | 0.005 |
| Barquat 4250(17) | — | — | 0.03 | — | — | — |
| Bardac 2050(18) | — | — | — | 0.03 | 0.03 | — |
| Perfume C | 0.08 | 0.08 | 0.05 | 0.05 | — | — |
| HCl | to pH 4 | — | — | — | — | — |
| Kathon CG | 3 ppm | 3 ppm | 3 ppm | 3 ppm | 3 ppm | 3 ppm |
| Distilled water | Bal. | Bal. | Bal. | Bal. | Bal. | Bal. |

(17)Benzalkonium chloride, 50% solution.
(18)Dioctyl dimethyl ammonium chloride, 50% solution.

The compositions of Examples I to VII (diluted when appropriate) are sprayed onto clothing using, e.g., the TS-800 sprayer from Calmar, and allowed to evaporate off of the clothing.

The compositions of Examples I to VII (diluted when appropriate) are sprayed onto clothing, using a blue inserted Guala ® trigger sprayer, available from Berry Plastics Corp. and a cylindrical Euromist II ® pump sprayer available from Seaquest Dispensing, respectively, and allowed to evaporate off of the clothing.

The compositions of Examples I to VII (diluted when appropriate) contained in rechargeable battery-operated Solo Spraystar sprayers are sprayed onto large surfaces of fabric, such as several pieces of clothing, and allowed to evaporate off of these surfaces. The level of coverage is uniform and the ease and convenience of application is superior to conventional manually operated trigger sprayers.

The compositions of Examples I to VII (diluted when appropriate) are used for soaking or dipping of fabrics which are then optionally wrung or squeezed to remove excess liquid and subsequently dried.

Following are Examples for rinse added fabric care compositions in accordance with the present invention:

EXAMPLE VIII

| Ingredients | Wt % | | | | |
|---|---|---|---|---|---|
| | VIIIa | VIIIb | VIIIc | VIIId | VIIIe |
| Polysaccharide | 1 | 2 | 2 | 3 | 2 |
| Fabric softener A(19) | 4.5 | — | — | — | — |
| Fabric softener B(20) | — | 24 | — | — | — |
| Fabric softener C(21) | — | — | 26 | — | — |
| Fabric softener D(22) | — | — | — | 28 | 28 |
| Fabric softener E(23) | 3.4 | — | — | — | — |
| 1,2-Hexanediol | — | — | 18 | — | — |
| 2-Ethyl-1,3-hexanediol | — | — | — | 6 | — |
| Neodol 91-8 | — | — | — | 5 | 3 |
| Pluronic L-350 | — | — | — | 1 | |
| Hexylene glycol | — | — | — | — | 3 |
| Hexylene glycol (from softener active) | — | — | — | 2.5 | 2.5 |
| Ethanol (from softener active) | — | 4.2 | 4.6 | 2.3 | 2.3 |
| Perfume B | 0.3 | 1.3 | 1.3 | 2 | 1.2 |
| Tenox 6 antioxidant | 0.02 | 0.04 | 0.04 | 0.04 | 0.04 |
| $CaCl_2$ | 0.05 | 0.4 | 0.5 | — | 2 |
| $MgCl_2$ | — | — | — | 1.6 | — |
| HCl | to pH 6 | to pH 3.5 | to pH 3.5 | to pH 3 | to pH 3 |
| Kathon CG | 3 ppm | 3 ppm | 3 ppm | 3 ppm | 3 ppm |
| Deionized water and other minor ingredients | Bal. | Bal. | Bal. | Bal. | Bal. |

(19)Di(hydrogenated tallowyl) dimethyl ammonium chloride/hydrogenated tallowyl trimethyl ammonium chloride blend of about 83:17 weight ratio.
(20)Di(acyloxyethyl) dimethyl ammonium chloride wherein the acyl group is derived from soft tallow fatty acids and with a diester-to-monoester weight ratio of about 11:1.

-continued

| Ingredients | Wt % | | | | |
|---|---|---|---|---|---|
| | VIIIa | VIIIb | VIIIc | VIIId | VIIIe |

[21]Di(acyloxyethyl) dimethyl ammonium chloride wherein the acyl group is derived from partially hydrogenated canola fatty acids and with a diester-to-monoester weight ratio of about 11:1.
[22]Di(acyloxyethyl)(2-hydroxyethyl)methyl ammonium methyl sulfate wherein the acyl group is derived from partially hydrogenated canola fatty acids.
[23]1-Tallow(amidoethyl)-2-tallowimidazoline.

EXAMPLE IX

| Ingredients | Wt % | | | | | |
|---|---|---|---|---|---|---|
| | IXa | IXb | IXc | IXd | IXe | IXf |
| Polysaccharide | 1 | 2 | 2 | 2 | 3 | 3 |
| Fabric softener A[19] | 4.5 | — | — | — | — | — |
| Fabric softener B[20] | — | 22 | 25 | 25 | — | — |
| Fabric softener E[23] | 3.4 | — | — | — | — | — |
| PVP K-15[24] | 1 | 3 | — | — | 5 | — |
| PVNO[25] | — | — | 1 | — | — | — |
| Cellulase[26] | — | — | — | 1 | — | 2 |
| Perfume B | 0.4 | 1.3 | 1.3 | 1.3 | 2 | — |
| Perfume C | — | — | — | — | — | 1.5 |
| Polysorbate 60 | — | — | — | — | 5 | 1 |
| HCl | to pH 5 | to pH 3.5 | to pH 3.5 | to pH 3.5 | — | — |
| Kathon CG | 3 ppm | 3 ppm | 3 ppm | 3 ppm | 3 ppm | 3 ppm |
| Deionized water and minor ingredients | Bal. | Bal. | Bal. | Bal. | Bal. | Bal. |

[19]Di(hydrogenated tallowyl) dimethyl ammonium chloride/hydrogenated tallowyl trimethyl ammonium chloride blend of about 83:17 weight ratio.
[20]Di(acyloxyethyl) dimethyl ammonium chloride wherein the acyl group is derived from soft tallow fatty acids and with a diester-to-monoester weight ratio of about 11:1.
[23]1-Tallow(amidoethyl)-2-tallowimidazoline.
[24]Polyvinylpyrrolidone with an average molecular weight of about 10,000.
[25]Poly(4-vinylpyridine-N-oxide) with an average molecular weight of about 25,000.
[26]The cellulase consists essentially of a homogeneous endoglucanase component, which is immunoreactive with an antibody raised against a highly purified 43 kD cellulase derived from *Humicola insolens*, DMS 1800, or which is homologous to said 43 kD endoglucanase; the cellulase solution used provides about 5,000 CEVU's per gram. Following are Examples for laundry detergent fabric care compositions in accordance with the present invention:

EXAMPLE X

| Ingredients | Wt % | |
|---|---|---|
| | Xa | Xb |
| LAS | 8 | 8 |
| C25E3 | 3.4 | 3.4 |
| QAS | — | 0.8 |
| Zeolite A | 17 | 17 |
| Carbonate | 13 | 24 |
| Silicate | 1.4 | 3 |
| Sulfate | 25 | 15 |
| PB4 | 9 | 8 |
| TAED | 1.5 | 1.5 |

-continued

| Ingredients | Wt % | |
|---|---|---|
| | Xa | Xb |
| DETPMP | 0.25 | 0.25 |
| HEDP | 0.3 | 0.3 |
| Polysaccharide | 3 | 5 |
| Protease | 26 ppm | 26 ppm |
| MA/AA | 0.3 | 0.3 |
| CMC | 0.2 | 0.2 |
| Photoactivated Bleach | — | 10 ppm |
| Brightener | 0.09 | 0.09 |
| Perfume | 0.3 | 0.3 |
| Silicone antifoam | 0.5 | 0.5 |
| Moisture and Miscellaneous | Balance | Balance |

EXAMPLE XI

Nil bleach-containing laundry detergent fabric care compositions of particular use in the washing if colored clothing:

| Ingredients | Wt % | |
|---|---|---|
| | XIa | XIb |
| Blown Powder | | |
| Zeolite A | 14 | 14 |
| Sodium sulfate | — | 13 |
| LAS | 2.8 | 3 |
| DETPMP | 0.4 | 0.5 |
| CMC | 0.4 | 0.4 |
| MA/AA | 3.8 | 4 |
| Agglomerates | | |
| LAS | 5.5 | 5 |
| TAS | 3 | 2 |
| Silicate | 4 | 4 |
| Zeolite A | 9 | 13 |
| Carbonate | 9 | 7 |
| Spray On | | |
| Perfume | 0.3 | 0.3 |
| C45E7 | 4 | 4 |
| C25E3 | 1.8 | 1.8 |
| Dry additives | | |
| Citrate | 10 | — |
| Bicarbonate | 6.5 | 3 |
| Carbonate | 7.5 | 5 |
| PVPVI/PVNO | 0.5 | 0.5 |
| Polysaccharide | 3 | 2 |
| Protease | 0.026 | 0.016 |
| Lipase | 0.009 | 0.009 |
| Amylase | 0.005 | — |
| Cellulase | 0.006 | 0.006 |
| Silicone antifoam | 4 | 3 |
| Moisture and Miscellaneous | Balance | Balance |

EXAMPLE XII

Examples of liquid detergent fabric care compositions according to the present invention:

| Ingredients | Wt % | | | | |
|---|---|---|---|---|---|
| | XIIa | XIIb | XIIc | XIId | XIIe |
| LAS | 9 | 8 | — | 22 | — |
| C25AS | 4 | 2 | 9 | — | 12 |

-continued

| Ingredients | Wt % | | | | |
|---|---|---|---|---|---|
| | XIIa | XIIb | XIIc | XIId | XIIe |
| C25E3S | 1 | — | 3 | — | 3.5 |
| C25E7 | 6 | 12 | 2.5 | — | 3.5 |
| TFAA | — | — | 4.5 | — | 7.5 |
| QAS | — | — | — | 3 | — |
| TPKFA | 2 | 12 | 2 | — | 5.5 |
| Canola fatty acids | — | — | 5 | — | 4 |
| Citric | 2 | 1 | 1.5 | 1 | 1 |
| Dodecenyl/tetradecenyl succinic acid | 10 | — | — | 14 | — |
| Oleic acid | 4 | 1 | — | 1 | — |
| Ethanol | 4 | 6 | 2 | 6 | 2 |
| 1,2 Propanediol | 4 | 2 | 6 | 6 | 10 |
| Mono Ethanol Amine | — | — | 5 | — | 8 |
| Tri Ethanol Amine | — | 7 | — | — | — |
| NaOH (pH) | 8 | 7.5 | 7.5 | 8 | 8 |
| Ethoxylated tetraethylene pentamine | 0.5 | 0.5 | 0.2 | — | 0.3 |
| DETPMP | 1 | 0.5 | 1 | 2 | — |
| SRP 2 | 0.3 | 0.3 | 0.1 | — | 0.1 |
| PVNO | — | — | — | — | 0.1 |
| Polysaccharide | 1 | 2 | 2 | 3 | 1 |
| Protease | 50 ppm | 40 ppm | 30 ppm | 0.08 | 60 ppm |
| Lipase | — | — | 2 ppm | — | 30 ppm |
| Amylase | 20 ppm | 50 ppm | 40 ppm | 20 ppm | 50 ppm |
| Cellulase | — | — | 1 ppm | — | 4 ppm |
| Boric acid | 0.1 | — | 2 | 1 | 2.5 |
| Na formate | — | 1 | — | — | — |
| Ca chloride | — | — | 0.01 | — | — |
| Bentonite clay | — | — | — | 3.5 | — |
| Suspending clay SD3 | — | — | — | 0.6 | — |
| Water and Miscellaneous | Bal. | Bal. | Bal. | Bal. | Bal. |

EXAMPLE XIII

Examples of syndet bar fabric detergent fabric care compositions in accord with the present invention:

| Ingredients | Wt % | |
|---|---|---|
| | XIVa | XIVb |
| C26 As | 18 | 18 |
| CFAA | 5 | 5 |
| LAS(C11–13) | 10 | 10 |
| Sodium carbonate | 22 | 25 |
| Sodium pyrophosphate | 6 | 6 |
| STPP | 6 | 6 |
| Zeolite A | 5 | 5 |
| CMC | 0.2 | 0.2 |
| Polyacrylate (MW 1400) | 0.2 | 0.2 |
| Coconut monoethanolamide | 5 | 5 |
| Polysaccharide | 5 | 3 |
| Amylase | — | 0.02 |
| Protease | — | 0.3 |
| Perfume | 0.2 | 0.2 |
| Brightener | 0.1 | 0.1 |
| $CaSO_4$ | 1 | 1 |
| $MgSO_4$ | 1 | 1 |
| Water | 4 | 4 |
| Filler | Balance | Balance |

Can be selected from convenient materials as $CaCO_3$, talc, clay, (Kaolinite, Smectite), silicates, and the like.

EXAMPLE XIV

Examples of syndet bar fabric detergent fabric care compositions in accord with the present invention:

| Ingredients | Wt. % | |
|---|---|---|
| | XIVa | XIVb |
| C26 AS | 20.00 | 20.00 |
| CFAA | 5.0 | 5.0 |
| LAS(C11–13) | 10.0 | 10.0 |
| Sodium carbonate | 25.0 | 25.0 |
| Sodium pyrophosphate | 7.0 | 7.0 |
| STPP | 7.0 | 7.0 |
| Zeolite A | 5.0 | 5.0 |
| CMC | 0.2 | 0.2 |
| Polyacrylate (MW 1400) | 0.2 | 0.2 |
| Coconut monoethanolamide | 5.0 | 5.0 |
| Polysaccharide | 3 | 5 |
| Amylase | 0.01 | 0.02 |
| Protease | 0.3 | — |
| Brightener, perfume | 0.2 | 0.2 |
| $CaSO_4$ | 1.0 | 1.0 |
| $MgSO_4$ | 1.0 | 1.0 |
| Water | 4.0 | 4.0 |
| Filler*: balance to 100% | | |

EXAMPLE XV

The following detergent formulations, according to the present invention, are prepared where XVa and XVc are phosphorus-containing detergent compositions, and XVb is a zeolite-containing detergent composition:

| | XVa | XVb | XVc |
|---|---|---|---|
| Blown Powder: | | | |
| STPP | 24.0 | — | 24.0 |
| Zeolite A | — | 24.0 | — |
| C45AS | 9.0 | 6.0 | 13.0 |
| MA/AA | 2.0 | 4.0 | 2.0 |
| LAS | 6.0 | 8.0 | 11.0 |
| TAS | 2.0 | — | — |
| Silicate | 7.0 | 3.0 | 3.0 |
| CMC | 1.0 | 1.0 | 0.5 |
| Brightener 2 | 0.2 | 0.2 | 0.2 |
| Soap | 1.0 | 1.0 | 1.0 |
| DETPMP | 0.4 | 0.4 | 0.2 |
| Spray On | | | |
| C45E7 | 2.5 | 2.5 | 2.0 |
| C25E3 | 2.5 | 2.5 | 2.0 |
| Silicone antifoam | 0.3 | 0.3 | 0.3 |
| Perfume | 0.3 | 0.3 | 0.3 |
| Dry additives: | | | |
| Carbonate | 6.0 | 13.0 | 15.0 |
| PB4 | 18.0 | 18.0 | 10.0 |
| PB1 | 4.0 | 4.0 | 0 |
| TAED | 3.0 | 3.0 | 1.0 |
| Photoactivated bleach | 0.02 | 0.02 | 0.02 |
| Polysaccharide | 1 | 2 | 1 |
| Protease | 0.01 | 0.01 | 0.01 |
| Lipase | 0.009 | 0.009 | — |
| Amylase | 0.002 | — | 0.001 |
| Dry mixed sodium sulfate | 3.0 | 3.0 | 5.0 |
| Balance (Moisture & Miscellaneous) | 100.0 | 100.0 | 100.0 |
| Density (g/litre) | 630 | 670 | 670 |

EXAMPLE XVI

The following nil bleach-containing detergent formulations of particular use in the washing of colored clothing, according to the present invention are prepared:

| | XVIa | XVIb | XVIc |
|---|---|---|---|
| Blown Powder | | | |
| Zeolite A | 15.0 | 15.0 | — |
| Sodium sulfate | 0.0 | 5.0 | — |
| LAS | 3.0 | 3.0 | — |
| DETPMP | 0.4 | 0.5 | — |
| CMC | 0.4 | 0.4 | — |
| MA/AA | 4.0 | 4.0 | — |
| Agglomerates | | | |
| C45AS | — | — | 11.0 |
| LAS | 6.0 | 5.0 | — |
| TAS | 3.0 | 2.0 | — |
| Silicate | 4.0 | 4.0 | — |
| Zeolite A | 10.0 | 15.0 | 13.0 |
| CMC | — | — | 0.5 |
| MA/AA | — | — | 2.0 |
| Carbonate | 9.0 | 7.0 | 7.0 |
| Spray On | | | |
| Perfume | 0.3 | 0.3 | 0.5 |
| C45E7 | 4.0 | 4.0 | 4.0 |
| C25E3 | 2.0 | 2.0 | 2.0 |

-continued

| | XVIa | XVIb | XVIc |
|---|---|---|---|
| Dry additives | | | |
| MA/AA | — | — | 3.0 |
| NaSKS-6 | — | — | 12.0 |
| Citrate | 10.0 | — | 8.0 |
| Bicarbonate | 7.0 | 3.0 | 5.0 |
| Carbonate | 8.0 | 5.0 | 7.0 |
| PVPVI/PVNO | 0.5 | 0.5 | 0.5 |
| Polysaccharide | 2 | 2 | 3 |
| Protease | 0.026 | 0.016 | 0.047 |
| Lipase | 0.009 | — | 0.009 |
| Amylase | 0.005 | 0.005 | — |
| Cellulase | 0.006 | 0.006 | — |
| Silicone antifoam | 5.0 | 5.0 | 5.0 |
| Dry additives | | | |
| Sodium sulfate | 0.0 | 9.0 | 0.0 |
| Balance (Moisture and Miscellaneous | 100.0 | 100.0 | 100.0 |
| Density (g/litre) | 700 | 7000 | 700 |

EXAMPLE XVII

The following liquid detergent formulations, according to the present invention are prepared:

| | XVIIa | XVIIb | XVIIc | XVIId | XVIIe | XVIIf | XVIIg | XVIIh |
|---|---|---|---|---|---|---|---|---|
| LAS | 10.0 | 13.0 | 9.0 | — | 25.0 | — | — | — |
| C25AS | 4.0 | 1.0 | 2.0 | 10.0 | — | 13.0 | 18.0 | 15.0 |
| C25E3S | 1.0 | — | — | 3.0 | — | 2.0 | 2.0 | 4.0 |
| C25E7 | 6.0 | 8.0 | 13.0 | 2.5 | — | — | 4.0 | 4.0 |
| TFAA | — | — | — | 4.5 | — | 6.0 | 8.0 | 8.0 |
| QAS | — | — | — | — | 3.0 | 1.0 | — | — |
| TPKFA | 2.0 | — | 13.0 | 2.0 | — | 15.0 | 7.0 | 7.0 |
| Rapeseed fatty acids | — | — | — | 5.0 | — | — | 4.0 | 4.0 |
| Citric | 2.0 | 3.0 | 1.0 | 1.5 | 1.0 | 1.0 | 1.0 | 1.0 |
| Dodecenyl/ tetradecenyl succinic acid | 12.0 | 10.0 | — | — | 15.0 | — | — | — |
| Oleic acid | 4.0 | 2.0 | 1.0 | — | 1.0 | — | — | — |
| Ethanol | 4.0 | 4.0 | 7.0 | 2.0 | 7.0 | 2.0 | 3.0 | 2.0 |
| 1,2 Propanediol | 4.0 | 4.0 | 2.0 | 7.0 | 6.0 | 8.0 | 10.0 | 13. |
| Mono Ethanol Amine | — | — | — | 5.0 | — | — | 9.0 | 9.0 |
| Tri Ethanol Amine | — | — | 8 | — | — | — | — | — |
| NaOH (pH) | 8.0 | 8.0 | 7.6 | 7.7 | 8.0 | 7.5 | 8.0 | 8.2 |
| Ethoxylated tetraethylene pentamine | 0.5 | — | 0.5 | 0.2 | — | — | 0.4 | 0.3 |
| DETPMP | 1.0 | 1.0 | 0.5 | 1.0 | 2.0 | 1.2 | 1.0 | — |
| SRP 2 | 0.3 | — | 0.3 | 0.1 | — | — | 0.2 | 0.1 |
| PVNO | — | — | — | — | — | — | — | 0.10 |
| Polysaccharide | 0.01 | 1.0 | 10.0 | 2 | 3 | 5 | 5 | 1.0 |
| Protease | .005 | .005 | .004 | .003 | 0.08 | .005 | .003 | .006 |
| Lipase | — | .002 | — | .0002 | — | — | .003 | .003 |
| Amylase | .002 | — | — | .004 | .002 | .008 | .005 | .005 |
| Cellulase | — | — | — | .0001 | — | — | .0004 | .0004 |
| Boric acid | 0.1 | 0.2 | — | 2.0 | 1.0 | 1.5 | 2.5 | 2.5 |
| Na formate | — | — | 1.0 | — | — | — | — | — |
| Ca chloride | — | 0.015 | — | 0.01 | — | — | — | — |
| Bentonite clay | — | — | — | — | 4.0 | 4.0 | — | — |
| Suspending clay SD3 | — | — | — | — | 0.6 | 0.3 | — | — |

-continued

| | XVIIa | XVIIb | XVIIc | XVIId | XVIIe | XVIIf | XVIIg | XVIIh |
|---|---|---|---|---|---|---|---|---|
| Balance Moisture and Miscellaneous | 100 | 100 | 100 | 100 | 100 | 100 | 100 | 100 |

EXAMPLE XVIII

Granular Fabric Cleaning Composition

| Component | Example No. A | B | C | D |
|---|---|---|---|---|
| Polysaccharide | 0.5 | 0.2 | 1 | 2 |
| Protease | 0.10 | 0.20 | 0.03 | 0.05 |
| $C_{13}$ linear alkyl benzene sulfonate | 22.00 | 22.00 | 22.00 | 22.00 |
| Phosphate (as sodium tripolyphosphates) | 23.00 | 23.00 | 23.00 | 23.00 |
| Sodium carbonate | 23.00 | 23.00 | 23.00 | 23.00 |
| Sodium silicate | 14.00 | 14.00 | 14.00 | 14.00 |
| Zeolite | 8.20 | 8.20 | 8.20 | 8.20 |
| Chelant (diethylaenetriamine-pentaacetic acid) | 0.40 | 0.40 | 0.40 | 0.40 |
| Sodium sulfate | 5.50 | 5.50 | 5.50 | 5.50 |
| Water | balance to 100% | | | |

EXAMPLE XIX

Granular Fabric Cleaning Composition

| Component | Example No. A | B | C | D |
|---|---|---|---|---|
| Polysaccharide | 1 | 3 | 5 | 0.4 |
| Protease | 0.10 | 0.20 | 0.03 | 0.05 |
| $C_{12}$ alkyl benzene sulfonate | 12.00 | 12.00 | 12.00 | 12.00 |
| Zeolite A (1–10 micrometer) | 26.00 | 26.00 | 26.00 | 26.00 |
| $C_{12-C14}$ secondary (2,3) alkyl sulfate, Na salt | 5.00 | 5.00 | 5.00 | 5.00 |
| Sodium citrate | 5.00 | 5.00 | 5.00 | 5.00 |
| Optic brightener | 0.10 | 0.10 | 0.10 | 0.10 |
| Sodium sulfate | 17.00 | 17.00 | 17.00 | 17.00 |
| Fillers, water, minors | balance to 100% | | | |

EXAMPLE XX

Granular Fabric Cleaning Compositions

| Components | Example No. A | B |
|---|---|---|
| Linear alkyl benzene sulphonate | 11.4 | 10.70 |
| Tallow alkyl sulphate | 1.80 | 2.40 |
| $C_{14-15}$ alkyl sulphate | 3.00 | 3.10 |
| $C_{14-15}$ alcohol 7 times ethoxylated | 4.00 | 4.00 |
| Tallow alcohol 11 times ethoxylated | 1.80 | 1.80 |
| Dispersant | 0.07 | 0.1 |
| Silicone fluid | 0.80 | 0.80 |
| Trisodium citrate | 14.00 | 15.00 |
| Citric acid | 3.00 | 2.50 |
| Zeolite | 32.50 | 32.10 |

-continued

Granular Fabric Cleaning Compositions

| Components | Example No. A | B |
|---|---|---|
| Maleic acid acrylic acid copolymer | 5.00 | 5.00 |
| Diethylene triamine penta methylene phosphonic acid | 1.00 | 0.20 |
| Polysaccharide | 1 | 3 |
| Protease | 0.1 | 0.01 |
| Lipase | 0.36 | 0.40 |
| Amylase | 0.30 | 0.30 |
| Sodium silicate | 2.00 | 2.50 |
| Sodium sulphate | 3.50 | 5.20 |
| Polyvinyl pyrrolidone | 0.30 | 0.50 |
| Perborate | 0.5 | 1 |
| Phenol sulphonate | 0.1 | 0.2 |
| Peroxidase | 0.1 | 0.1 |
| Minors | Up to 100 | Up to 100 |

EXAMPLE XXI

Granular Fabric Cleaning Compositions

| Components | Example No. A | B |
|---|---|---|
| Sodium linear $C_{12}$ alkyl benzene-sulfonate | 6.5 | 8.0 |
| Sodium sulfate | 15.0 | 18.0 |
| Zeolite A | 26.0 | 22.0 |
| Sodium nitrilotriacetate | 5.0 | 5.0 |
| Polyvinyl pyrrolidone | 0.5 | 0.7 |
| Tetraacetylethylene diamine | 3.0 | 3.0 |
| Boric acid | 4.0 | — |
| Perborate | 0.5 | 1 |
| Phenol sulphonate | 0.1 | 0.2 |
| Polysaccharide | 2 | 0.5 |
| Protease | 0.02 | 0.05 |
| Fillers (e.g., silicates; carbonates; perfumes; water) | Up to 100 | Up to 100 |

EXAMPLE XXII

Compact Granular Fabric Cleaning Composition

| Components | Weight % |
|---|---|
| Alkyl Sulphate | 8.0 |
| Alkyl Ethoxy Sulphate | 2.0 |
| Mixture of C25 and C45 alcohol 3 and 7 times ethoxylated | 6.0 |
| Polyhydroxy fatty acid amide | 2.5 |
| Zeolite | 17.0 |
| Layered silicate/citrate | 16.0 |
| Carbonate | 7.0 |
| Maleic acid acrylic acid copolymer | 5.0 |

-continued

Compact Granular Fabric Cleaning Composition

| Components | Weight % |
|---|---|
| Soil release polymer | 0.4 |
| Carboxymethyl cellulose | 0.4 |
| Poly (4-vinylpyridine)-N-oxide | 0.1 |
| Copolymer of vinylimidazole and vinylpyrrolidone | 0.1 |
| PEG2000 | 0.2 |
| Polysaccharide | |
| Protease | 0.03 |
| Lipase | 0.2 |
| Cellulase | 0.2 |
| Tetracetylethylene diamine | 6.0 |
| Percarbonate | 22.0 |
| Ethylene diamine disuccinic acid | 0.3 |
| Suds suppressor | 3.5 |
| Disodium-4,4'-bis (2-morpholino-4-anilino-s-triazin-6-ylamino) stilbene-2,2'-disulphonate | 0.25 |
| Disodium-4,4'-bis (2-sulfostyril) biphenyl | 0.05 |
| Water, Perfume and Minors | Up to 100 |

EXAMPLE XXIII

Granular Fabric Cleaning Composition

| Components | Weight % |
|---|---|
| Linear alkyl benzene sulphonate | 7.6 |
| $C_{16}$–$C_{18}$ alkyl sulfate | 1.3 |
| $C_{14-15}$ alcohol 7 times ethoxylated | 4.0 |
| Coco-alkyl-dimethyl hydroxyethyl ammonium chloride | 1.4 |
| Dispersant | 0.07 |
| Silicone fluid | 0.8 |
| Trisodium citrate | 5.0 |
| Zeolite 4A | 15.0 |
| Maleic acid acrylic acid copolymer | 4.0 |
| Diethylene triamine penta methylene phosphonic acid | 0.4 |
| Perborate | 15.0 |
| Tetraacetylethylene diamine | 5.0 |
| Smectite clay | 10.0 |
| Poly (oxyethylene) (MW 300,000) | 0.3 |
| Polysaccharide | 0.8 |
| Protease | 0.02 |
| Lipase | 0.2 |
| Amylase | 0.3 |
| Cellulase | 0.2 |
| Sodium silicate | 3.0 |
| Sodium carbonate | 10.0 |
| Carboxymethyl cellulose | 0.2 |
| Brighteners | 0.2 |
| Water, perfume and minors | Up to 100 |

EXAMPLE XXIV

Granular Fabric Cleaning Composition

| Components | Weight % |
|---|---|
| Linear alkyl benzene sulfonate | 6.92 |
| Tallow alkyl sulfate | 2.05 |
| $C_{14-15}$ alcohol 7 times ethoxylated | 4.4 |
| $C_{12-15}$ alkyl ethoxy sulfate - 3 times ethoxylated | 0.16 |
| Zeolite | 20.2 |
| Citrate | 5.5 |
| Carbonate | 15.4 |
| Silicate | 3.0 |
| Maleic acid acrylic acid copolymer | 4.0 |
| Carboxymethyl cellulase | 0.31 |

-continued

Granular Fabric Cleaning Composition

| Components | Weight % |
|---|---|
| Soil release polymer | 0.30 |
| Polysaccharide | 0.5 |
| Protease | 0.1 |
| Lipase | 0.36 |
| Cellulase | 0.13 |
| Perborate tetrahydrate | 11.64 |
| Perborate monohydrate | 8.7 |
| Tetraacetylethylene diamine | 5.0 |
| Diethylene tramine penta methyl phosphonic acid | 0.38 |
| Magnesium sulfate | 0.40 |
| Brightener | 0.19 |
| Perfume, silicone, suds suppressors | 0.85 |
| Minors | Up to 100 |

EXAMPLE XXV

Granular Fabric Cleaning Composition

| Component | A | B | C |
|---|---|---|---|
| Base Granule Components | | | |
| LAS/AS/AES (65/35) | 9.95 | — | — |
| LAS/AS/AES (70/30) | — | 12.05 | 7.70 |
| Alumino silicate | 14.06 | 15.74 | 17.10 |
| Sodium carbonate | 11.86 | 12.74 | 13.07 |
| Sodium silicate | 0.58 | 0.58 | 0.58 |
| NaPAA Solids | 2.26 | 2.26 | 1.47 |
| PEG Solids | 1.01 | 1.12 | 0.66 |
| Brighteners | 0.17 | 0.17 | 0.11 |
| DTPA | — | — | 0.70 |
| Sulfate | 5.46 | 6.64 | 4.25 |
| DC-1400 Deaerant | 0.02 | 0.02 | 0.02 |
| Moisture | 3.73 | 3.98 | 4.33 |
| Minors | 0.31 | 0.49 | 0.31 |
| B.O.T. Spray-on | | | |
| Nonionic surfactant | 0.50 | 0.50 | 0.50 |
| Agglomerate Components | | | |
| LAS/AS (25/75) | 11.70 | 9.60 | 10.47 |
| Alumino silicate | 13.73 | 11.26 | 12.28 |
| Carbonate | 8.11 | 6.66 | 7.26 |
| PEG 4000 | 0.59 | 0.48 | 0.52 |
| Moisture/Minors | 4.88 | 4.00 | 4.36 |
| Functional Additives | | | |
| Sodium carbonate | 7.37 | 6.98 | 7.45 |
| Perborate | 1.03 | 1.03 | 2.56 |
| TAED | — | 1.00 | — |
| NOBS | — | — | 2.40 |
| Soil release polymer | 0.41 | 0.41 | 0.31 |
| Polysaccharide | 1 | 0.75 | 3 |
| Cellulase | 0.33 | 0.33 | 0.24 |
| Protease | 0.1 | 0.05 | 0.15 |
| AE-Flake | 0.40 | 0.40 | 0.29 |
| Liquid Spray-on | | | |
| Perfume | 0.42 | 0.42 | 0.42 |
| Noionic spray-on | 1.00 | 1.00 | 0.50 |
| Minors | | Up to 100 | |

EXAMPLE XXVI

| Granular Fabric Cleaning Composition | A | B |
|---|---|---|
| Surfactant | | |
| Na LAS | 6.40 | — |
| KLAS | — | 9.90 |
| AS/AE3S | 6.40 | 4.39 |
| TAS | 0.08 | 0.11 |
| C24AE5 | 3.48 | — |
| Genagen | — | 1.88 |
| N-cocoyl N-methyl glucamine (lin) | 1.14 | 2.82 |
| $C_{8-10}$ dimethyl hydroxyethyl ammonium chloride | 1.00 | 1.40 |
| Builder | | |
| Zeolite | 20.59 | 13.39 |
| SKS-6 | 10.84 | 10.78 |
| Citric Acid | 2.00 | 2.00 |
| Buffer | | |
| Carbonate | 9.60 | 12.07 |
| Bicarbonate | 2.00 | 2.00 |
| Sulphate | 2.64 | — |
| Silicate | 0.61 | 0.16 |
| Polymer | | |
| Acrylic acid/maleic acid copolymer (Na) | 1.17 | 1.12 |
| Carboxymethyl cellulose | 0.45 | 0.24 |
| Polymer | 0.34 | 0.18 |
| Hexamethylene-diamine tetra-E24 ethoxylate, diquaternized with methyl chloride | 1.00 | 1.00 |
| Enzyme | | |
| Protease (% pure enzyme) | 0.03 | 0.03 |
| Cellulase | 0.26 | 0.26 |
| Amylase | 0.65 | 0.73 |
| Lipase | 0.27 | 0.15 |
| Bleach | | |
| TAED (100%) | 3.85 | 3.50 |
| Phenolsulfonate ester of N-nonanoyl-6-aminocaproic acid | — | 2.75 |
| Percarbonate | 16.20 | 18.30 |
| HEDP | 0.48 | 0.48 |
| EDDS | 0.30 | 0.30 |
| Miscellaneous | | |
| Polysaccharide | 1 | 2 |
| Malic particle | | 2.20 + bicarb |
| Brightener 15/49 | 0.077/0.014 | 0.07/0.014 |
| Zinc phthalocyanine sulfonate | 0.0026 | 0.0026 |
| Polydimethylsiloxane with trimethylsilyl end blocking units | 0.25 | 0.24 |
| Soap | — | 1.00 |
| Perfume | 0.45 | 0.55 |
| TOTAL | 100 | 100 |

EXAMPLE XXVII

| Granular Fabric Cleaning Composition | A | B |
|---|---|---|
| Surfactant | | |
| NaLAS | 6.8 | 0.4 |
| KLAS | — | 10.9 |
| FAS | 0.9 | 0.1 |
| AS | 0.6 | 1.5 |
| C25AE3S | 0.1 | — |
| AE5 | 4.2 | — |
| N-Cocoyl-N-Methyl Glucamine | — | 1.8 |
| Genagen | — | 1.2 |
| $C_{8-10}$ dimethyl hydroxyethyl ammonium chloride | — | 1.0 |
| Builder | | |
| SKS-6 | 3.3 | 9.0 |
| Zeolite | 17.2 | 18.9 |
| Citric Acid | 1.5 | — |
| Buffer | | |
| Carbonate | 21.1 | 15.0 |
| Sodium Bicarbonate | — | 2.6 |
| Sulphate | 15.2 | 5.5 |
| Malic Acid | — | 2.9 |
| Silicate | 0.1 | — |
| Polymer | | |
| Acrylic acid/maleic acid copolymer (Na) | 2.2 | 0.9 |
| Hexamethylene-diamine tetra-E24 ethoxylate, diquaternized with methyl chloride | 0.5 | 0.7 |
| Polymer | 0.1 | 0.1 |
| CMC | 0.2 | 0.1 |
| Enzymes | | |
| Protease (% pure enzyme) | 0.02 | 0.05 |
| Lipase | 0.18 | 0.14 |
| Amylase | 0.64 | 0.73 |
| Cellulase | 0.13 | 0.26 |
| Bleach | | |
| TAED | 2.2 | 2.5 |
| Phenolsulfonate ester of N-nonanoyl-6-aminocaproic acid | — | 1.96 |
| Sodium Percarbonate | — | 13.1 |
| PB4 | 15.6 | — |
| EDDS | 0.17 | 0.21 |
| $MgSO_4$ | 0.35 | 0.47 |
| HEDP | 0.15 | 0.34 |
| Miscellaneous | | |
| Polysaccharide | 2 | 1 |
| Brightener | 0.06 | 0.04 |
| Zinc phthalocyanine sulfonate | 0.0015 | 0.0020 |
| Polydimethylsiloxane with trimethylsilyl end blocking units | 0.04 | 0.14 |
| Soap | 0.5 | 0.7 |
| Perfume | 0.35 | 0.45 |
| Speckle | 0.5 | 0.6 |

EXAMPLE XXVIII

The following granular laundry detergent compositions XXVIII A–C are of particular utility under European machine wash conditions were prepared in accord with the invention:

| Component | A | B | C |
|---|---|---|---|
| LAS | 7.0 | 5.61 | 4.76 |
| TAS | — | — | 1.57 |
| C45AS | 6.0 | 2.24 | 3.89 |
| C25E3S | 1.0 | 0.76 | 1.18 |
| C45E7 | | — | 2.0 |
| C25E3 | 4.0 | 5.5 | — |
| QAS | 0.8 | 2.0 | 2.0 |
| STPP | | — | — |
| Zeolite A | 25.0 | 19.5 | 19.5 |
| Citric acid | 2.0 | 2.0 | 2.0 |
| NaSKS-6 | 8.0 | 10.6 | 10.6 |
| Carbonate I | 8.0 | 10.0 | 8.6 |
| MA/AA | 1.0 | 2.6 | 1.6 |
| CMC | 0.5 | 0.4 | 0.4 |
| PB4 | — | 12.7 | — |
| Percarbonate | — | — | 19.7 |
| TAED | | 3.1 | 5.0 |
| Citrate | 7.0 | — | — |
| DTPMP | 0.25 | 0.2 | 0.2 |
| HEDP | 0.3 | 0.3 | 0.3 |
| QEA 1 | 0.9 | 1.2 | 1.0 |
| Polysaccharide | 0.5 | 0.2 | 1 |
| Protease | 0.02 | 0.05 | 0.035 |
| Lipase | 0.15 | 0.25 | 0.15 |
| Cellulase | 0.28 | 0.28 | 0.28 |
| Amylase | 0.4 | 0.7 | 0.3 |
| PVPI/PVNO | 0.4 | — | 0.1 |
| Photoactivated bleach (ppm) | 15 ppm | 27 ppm | 27 ppm |
| Brightener 1 | 0.08 | 0.19 | 0.19 |
| Brightener 2 | — | 0.04 | 0.04 |
| Perfume | 0.3 | 0.3 | 0.3 |
| Effervescent granules (malic acid 40%, sodium bicarbonate 40%, sodium carbonate 20%) | 15 | 15 | 5 |
| Silicone antifoam | 0.5 | 2.4 | 2.4 |
| Minors/inerts to 100% | | | |

EXAMPLE XXIX

The following formulations are examples of compositions in accordance with the invention, which may be in the form of granules or in the form of a tablet.

| Component | XXIX |
|---|---|
| C45 AS/TAS | 3.0 |
| LAS | 8.0 |
| C25 AE3S | 1.0 |
| NaSKS-6 | 9.0 |
| C25 AE5/AE3 | 5.0 |
| Zeolite A | 10.0 |
| SKS-6 (I) (dry add) | 2.0 |
| MA/AA | 2.0 |
| Citric acid | 1.5 |
| EDDS | 0.5 |
| HEDP | 0.2 |
| PB1 | 10.0 |
| NACA OBS | 2.0 |
| TAED | 2.0 |
| Carbonate | 8.0 |
| Sulphate | 2.0 |
| Polysaccharide | 5 |
| Amylase | 0.3 |
| Lipase | 0.2 |

-continued

| Component | XXIX |
|---|---|
| Protease | 0.02 |
| Minors (Brightener/SRP1/CMC/Photobleach/$MgSO_4$/PVPVI/Suds suppressor/PEG) | 0.5 |
| Perfume | 0.5 |

EXAMPLE XXX

Granular laundry detergent compositions XXX A–E are of particular utility under Japanese machine wash conditions and are prepared in accordance with the invention:

| Component | A | B | C | D | E |
|---|---|---|---|---|---|
| LAS | 23.57 | 23.57 | 21.67 | 21.68 | 21.68 |
| FAS | 4.16 | 4.16 | 3.83 | 3.83 | 3.83 |
| Nonionic surfactant | 3.30 | 3.30 | 2.94 | 3.27 | 3.27 |
| Bis (hydroxyethyl) methyl alkyl ammonium chloride | 0.47 | 0.47 | 1.20 | 1.20 | 1.20 |
| SKS-6 | 7.50 | 7.50 | 5.17 | 5.76 | 5.06 |
| Polyacrylate copolymer (MW 11000) (maleic/acrylate ratio of 4:6) | 7.03 | 7.03 | 14.36 | 14.36 | 14.36 |
| Zeolite | 11.90 | 11.40 | 10.69 | 11.34 | 11.34 |
| Carbonate | 14.90 | 14.82 | 11.71 | 11.18 | 11.18 |
| Silicate | 12.00 | 12.00 | 12.37 | 12.38 | 12.38 |
| Polysaccharide | 5 | 2 | 1 | 0.4 | 0.6 |
| Protease | 0.016 | 0.016 | 0.046 | 0.046 | 0.046 |
| Lipase | — | — | 0.28 | — | — |
| Amylase | — | — | 0.62 | — | — |
| Cellulase | — | — | 0.48 | — | 0.70 |
| NOBS | 3.75 | 3.75 | 2.70 | 2.70 | 2.70 |
| PB1 | 3.53 | — | 2.60 | — | — |
| Sodium percarbonate | — | 4.21 | — | 3.16 | 3.16 |
| SRP | 0.52 | 0.52 | 0.70 | 0.70 | 0.70 |
| Brightener | 0.31 | 0.31 | 0.28 | 0.28 | 0.50 |
| AE-coflake | 0.17 | 0.20 | 0.17 | 0.17 | 0.17 |
| Polydimethylsiloxane | — | — | 0.68 | 0.68 | 0.68 |
| Perfume | 0.06 | 0.06 | 0.08 | — | — |
| Perfume | — | — | — | 0.23 | 0.23 |
| Hydrophobic precipitated silica | 0.30 | 0.30 | 0.30 | 0.30 | 0.30 |
| PEG4000 | 0.19 | 0.19 | 0.17 | 0.17 | 0.17 |
| Minors/inerts to 100% | | | | | |

EXAMPLE XXXI

Liquid Fabric Cleaning Compositions

| | Example No. | | | | |
|---|---|---|---|---|---|
| Component | A | B | C | D | E |
| Polysaccharide | 0.5 | 1 | 2 | 5 | 1 |
| Protease | 0.05 | 0.03 | 0.30 | 0.03 | 0.10 |
| $C_{12}$–$C_{14}$ alkyl sulfate, Na | 20.00 | 20.00 | 20.00 | 20.00 | 20.00 |
| 2-Butyl octanoic acid | 5.00 | 5.00 | 5.00 | 5.00 | 5.00 |
| Sodium citrate | 1.00 | 1.00 | 1.00 | 1.00 | 1.00 |
| $C_{10}$ alcohol ethoxylate (3) | 13.00 | 13.00 | 13.00 | 13.00 | 13.00 |
| Monethanolamine | 2.50 | 2.50 | 2.50 | 2.50 | 2.50 |
| Water/propylene glycol/ethanol (100:1:1) | balance to 100% | | | | |

EXAMPLE XXXII

Liquid Fabric Cleaning Compositions

| Component | Example No. A | Example No. B |
|---|---|---|
| $C_{12-14}$ alkenyl succinic acid | 3.0 | 8.0 |
| Citric acid monohydrate | 10.0 | 15.0 |
| Sodium $C_{12-15}$ alkyl sulphate | 8.0 | 8.0 |
| Sodium sulfate of $C_{12-15}$ alcohol 2 times ethoxylated | — | 3.0 |
| $C_{12-15}$ alcohol 7 times ethoxylated | — | 8.0 |
| Diethylene triamine penta (methylene phosphonic acid) | 0.2 | — |
| Oleic acid | 1.8 | — |
| Ethanol | 4.0 | 4.0 |
| Propanediol | 2.0 | 2.0 |
| Polysaccharide | 1 | 2 |
| Protease | 0.01 | 0.02 |
| Polyvinyl pyrrolidone | 1.0 | 2.0 |
| Suds suppressor | 0.15 | 0.15 |
| NaOH | up to pH 7.5 | |
| Perborate | 0.5 | 1 |
| Phenol sulphonate | 0.1 | 0.2 |
| Peroxidase | 0.4 | 0.1 |
| Waters and minors | up to 100% | |

EXAMPLE XXXIII

Liquid Fabric Cleaning Compositions

| Component | Example No. 40 |
|---|---|
| NaLAS (100% am) | 16 |
| Neodol | 21.5 |
| Citrate | 6.8 |
| EDDS | 1.2 |
| Dispersant | 1.3 |
| Perborate | 12 |
| Phenolsulfonate ester of N-nonanoyl-6-aminocaproic acid | 6 |
| Polysaccharide | 0.5 |
| Protease (% pure enzyme) | 0.03 |
| Amylase | 0.40 |
| Cellulase | 0.03 |
| Solvent (BPP) | 18.5 |
| Polymer | 0.1 |
| Carbonate | 10 |
| FWA 15 | 0.2 |
| $TiO_2$ | 0.5 |
| PEG 8000 | 0.4 |
| Perfume | 1.0–1.2 |
| Suds suppressor | 0.06 |
| Waters and minors | up to 100% |

EXAMPLE XXXIV

Liquid Fabric Cleaning Compositions

| Component | Example No. A | Example No. B |
|---|---|---|
| D1 $H_2O$ | 38.63 | — |
| MEA | 0.48 | 9.0 |
| NaOH | 4.40 | 1.0 |
| Pdiol | 4.00 | 10.0 |
| Citric acid | 2.50 | 2.0 |
| Sodium sulfate | 1.75 | — |
| DTPA | 0.50 | 1.0 |

-continued

Liquid Fabric Cleaning Compositions

| Component | Example No. A | Example No. B |
|---|---|---|
| FWA Premix (Br 15/MEA/N1 23-9) | 0.15 | 0.15 |
| Na C25AE1.80S | 23.50 | — |
| AE3S (11) | — | 4.0 |
| C11.8HLAS | 3.00 | 14.0 |
| Neodol | 2.00 | 6.0 |
| EtOH | 0.50 | 2.0 |
| Ca*Formate | 0.10 | 0.1 |
| Borax premix (Borax/MEA/Pdiol/Citric Acid) | 2.50 | — |
| Boric acid | — | 1.0 |
| C10 APA | 1.50 | — |
| TEPA 105 | 1.20 | — |
| FA C12–18 | 5.00 | — |
| Neptune LC | 0.50 | — |
| Dye | 0.0040 | 0.0015 |
| Polysaccharide | 1 | 0.7 |
| Cellulase | 0.053 | 0.2 |
| Amylase | 0.15 | 0.2 |
| Protease | 0.1 | 0.1 |
| DC 2-3597 | 0.12 | 0.2 |
| Rapeseed FA | 6.50 | 4.0 |
| Waters and minors | up to 100% | |

EXAMPLE XXXV

Liquid Fabric Cleaning Composition

| Component | XXXV |
|---|---|
| NaOH | 5.50 |
| Pdiol | 6.90 |
| Citric acid | 1.50 |
| DTPA | 1.50 |
| FWA Premix (Br 15/MEA/N1 23-9) | 0.15 |
| AE3S (H) | 2.50 |
| LAS (H) | 13.0 |
| Neodol | 2.00 |
| EtOH | 3.50 |
| Ca*Formate | 0.10 |
| Boric acid | 1.00 |
| Clay | 4.00 |
| Polysaccharide | 2 |
| Amylase | 0.15 |
| Protease | 0.02 |
| Fatty Acid | 16.50 |
| Waters and minors | up to 100% |

EXAMPLE XXXVI

Liquid Fabric Cleaning Composition

Liquid fabric cleaning composition of particular utility under Japanese machine wash conditions is prepared in accordance with the invention:

| Component | XXXVI |
|---|---|
| AE2.5S | 15.00 |
| AS | 5.50 |
| N-Cocoyl N-methyl glucamine | 5.00 |
| Nonionic surfactant | 4.50 |
| Citric acid | 3.00 |
| Fatty acid | 5.00 |
| Base | 0.97 |
| Monoethanolamine | 5.10 |
| 1,2-Propanediol | 7.44 |

-continued

Liquid Fabric Cleaning Composition

Liquid fabric cleaning composition of particular utility under Japanese machine wash conditions is prepared in accordance with the invention:

| Component | XXXVI |
|---|---|
| EtOH | 5.50 |
| HXS | 1.90 |
| Boric acid | 3.50 |
| Ethoxylated tetraethylene-pentaimine | 3.00 |
| SRP | 0.30 |
| Polysaccharide | 1 |
| Protease | 0.069 |
| Amylase | 0.06 |
| Cellulase | 0.08 |
| Lipase | 0.18 |
| Brightener | 0.10 |
| Minors/inerts to 100% | |

EXAMPLE XXXVII

Liquid Fabric Cleaning Composition

Liquid fabric cleaning composition of particular utility under Japanese machine wash conditions and for fine fabrics is prepared in accordance with the invention:

| Component | XXXVII |
|---|---|
| AE2.5S | 2.16 |
| AS | 3.30 |
| N-Cocoyl N-methyl glucamine | 1.10 |
| Nonionic surfactant | 10.00 |
| Citric acid | 0.40 |
| Fatty acid | 0.70 |
| Base | 0.85 |
| Monoethanolamine | 1.01 |
| 1,2-Propanediol | 1.92 |
| EtOH | 0.24 |
| HXS | 2.09 |
| Polysaccharide | 2 |
| Protease | 0.01 |
| Amylase | 0.06 |
| Minors/inerts to 100% | |

EXAMPLE XXXVIII

Bar Fabric Cleaning Compositions

| Component | Example No. A | B | C | D |
|---|---|---|---|---|
| Polysaccharide | 0.5 | 2 | 5 | 3 |
| Protease | 0.3 | 0.05 | 0.1 | 0.02 |
| $C_{12}$–$C_{16}$ alkyl sulfate, Na | 20.0 | 20.0 | 20.0 | 20.00 |
| $C_{12}$–$C_{14}$ N-methyl glucamide | 5.0 | 5.0 | 5.0 | 5.00 |
| $C_{11}$–$C_{13}$ alkyl benzene sulfonate, Na | 10.0 | 10.0 | 10.0 | 10.00 |
| Sodium pyrophosphate | 7.0 | 7.0 | 7.0 | 7.00 |
| Sodium tripolyphosphate | 7.0 | 7.0 | 7.0 | 7.00 |
| Zeolite A (0.1–.10$\mu$) | 5.0 | 5.0 | 5.0 | 5.00 |
| Carboxymethylcellulose | 0.2 | 0.2 | 0.2 | 0.20 |
| Polyacrylate (MW 1400) | 0.2 | 0.2 | 0.2 | 0.20 |
| Coconut monethanolamide | 5.0 | 5.0 | 5.0 | 5.00 |
| Brightener, perfume | 0.2 | 0.2 | 0.2 | 0.20 |
| $CasO_4$ | 1.0 | 1.0 | 1.0 | 1.00 |

-continued

Bar Fabric Cleaning Compositions

| Component | Example No. A | B | C | D |
|---|---|---|---|---|
| $MgSO_4$ | 1.0 | 1.0 | 1.0 | 1.00 |
| Water | 4.0 | 4.0 | 4.0 | 4.00 |
| Filler* | | balance to 100% | | |

*Can be selected from convenient materials such as $CaCO_3$, talc, clay, silicates, and the like.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

In addition to the above examples, the cotyledon extracts of the present invention can be formulated into any suitable laundry detergent composition, non-limiting examples of which are described in U.S. Pat. No. 5,679,630 Baeck et al., issued Oct. 21, 1997; U.S. Pat. No. 5,565,145 Watson et al., issued Oct. 15, 1996; U.S. Pat. No. 5,478,489 Fredj et al., issued Dec. 26, 1995; U.S. Pat. No. 5,470,507 Fredj et al., issued Nov. 28, 1995; U.S. Pat. No. 5,466,802 Panandiker et al., issued Nov. 14, 1995; U.S. Pat. No. 5,460,752 Fredj et al., issued Oct. 24, 1995; U.S. Pat. No. 5,458,810 Fredj et al., issued Oct. 17, 1995; U.S. Pat. No. 5,458,809 Fredj et al., issued Oct. 17, 1995; U.S. Pat. No. 5,288,431 Huber et al., issued Feb. 22, 1994 all of which are incorporated herein by reference.

Having described the invention in detail with reference to preferred embodiments and the examples, it will be clear to those skilled in the art that various changes and modifications may be made without departing from the scope of the invention and the invention is not to be considered limited to what is described in the specification.

What is claimed is:

1. A starch-free treating composition for treating a fabric in need of treatment comprising a polysaccharide having a degree of polymerization in the range of from about 40 to about 100,000 and a second material selected from the group consisting of a derivatized polysaccharide, an oligosaccharide, a monosaccharide, and mixtures thereof.

2. The composition according to claim 1, wherein said polysaccharide has a molecular weight in the range of from about 10,000 to about 10,000,000.

3. The composition according to claim 1, wherein said polysaccharide is selected from the group consisting of gums, arabinans, galactans, seeds and mixtures thereof.

4. The composition according to claim 1, wherein said polysaccharide is present in said treating composition at a level of from about 0.01% to about 25% by weight of said treating composition.

5. The composition according to claim 1, wherein said composition further comprises one or more ingredients selected from the group consisting of surfactants, builders, bleaching agents, dye transfer inhibiting agents, chelants, dispersants, polysaccharides, softening agents, suds suppressors, carriers, enzymes, enzyme stabilizing systems, polyacids, soil removal agents, anit-redoposition agents, hydrotropes, opacifiers, antioxidants, bactericides, dyes, perfumes, brighteners, anti-encrustation agents and mixtures thereof.

6. The composition according to claim 1, wherein said composition comprises a derivatized polysaccharide selected from the group consisting of amino alginates, O-methyl-(N-1,12-dodecanediamine) cellulose, biotin heparin, carboxymethylated dextran, guar polycarboxylic acid, carboxymethylated locust bean gum, caroxymethylated xanthan, carboxymethylated pachyman, chitosan phosphate, chitosan phosphate sulfate, diethylaminoethyl dextran, dodecylamide alginate and mixtures thereof.

7. The composition according to claim 1, wherein said composition comprises an oligosaccharide, said oligosaccharide comprising a degree of polymerization of less than about 20 and one or more monosaccharides selected from the group consisting of glucose, fructose, galactose, zylose, mannose, arabinose, rhamnose, ribose, lyxose, allose, altrose, gulose, idose, talose and their derivatives.

8. A method of treating a fabric in need of treatment comprising contacting said fabric with an effective amount of a polysaccharide-containing treating composition according to claim 1.

9. The method according to claim 8, wherein said fabric is imparted color appearance and/or pill prevention and/or abrasion resistance and/or wrinkle resistance and/or shrinkage resistance properties following treatment via said method.

10. The method according to claim 8, wherein said polysaccharide-containing treating composition further comprises one or more cleaning adjunct materials selected from the group consisting of surfactants, builders, bleaching agents, dye transfer inhibiting agents, chelants, dispersants, polysaccharides, softening agents, suds suppressors, carriers, enzymes, enzyme stabilizing systems, polyacids, soil removal agents, anti-redeoposition agents, hydrotropes, opacifiers, antioxidants, bactericides, dyes, perfumes, brighteners and mixtures thereof.

11. The method according to claim 8, wherein said polysaccharide-containing treating composition is applied to said fabric via a spray dispenser.

12. A fabric treated with the method according to claim 8.

13. A treating composition for treating a fabric in need of treatment, said composition comprising:

A) a polysaccharide having a degree of polymerization of over 40;

B) at least one of the following material: a derivatized polysaccharide, an oligosaccharide and one or more monosaccharides;

C) one or more cleaning adjunct materials selected from the group consisting of: builders, bleaching agents, dye transfer inhibiting agents, chelants, dispersants, polysaccharides, softening agents, suds suppressors, carriers, enzymes, enzyme stabilizing systems, polyacids, soil removal agents, anti-redeoposition agents, hydrotropes, opacifiers, antioxidants, bactericides, dyes, perfumes, brighteners and mixtures thereof; and D) optionally, a surfactant.

* * * * *